US007956711B2

(12) United States Patent
Fullerton et al.

(10) Patent No.: US 7,956,711 B2
(45) Date of Patent: Jun. 7, 2011

(54) APPARATUSES AND METHODS RELATING TO TOOL ATTACHMENTS THAT MAY BE REMOVABLY CONNECTED TO AN EXTENSION HANDLE

(75) Inventors: Larry W. Fullerton, New Hope, AL (US); Mark D. Roberts, Huntsville, AL (US)

(73) Assignee: Cedar Ridge Research, LLC., New Hope, AL (US)

( * ) Notice: Subject to any disclaimer, the term of this patent is extended or adjusted under 35 U.S.C. 154(b) by 168 days.

(21) Appl. No.: 12/496,463

(22) Filed: Jul. 1, 2009

(65) Prior Publication Data

US 2009/0288528 A1 Nov. 26, 2009

Related U.S. Application Data

(63) Continuation-in-part of application No. 12/476,952, filed on Jun. 2, 2009, which is a continuation-in-part of application No. 12/322,561, filed on Feb. 4, 2009, which is a continuation-in-part of application No. 12/358,423, filed on Jan. 23, 2009, now Pat. No. 7,868,721, which is a continuation-in-part of application No. 12/123,718, filed on May 20, 2008, now Pat. No. 7,800,471.

(51) Int. Cl.
*H01F 7/02* (2006.01)

(52) U.S. Cl. ..... 335/285; 335/306; 15/144.3; 15/145; 81/177.2; 172/372

(58) Field of Classification Search ..... 335/285, 335/306; 15/143.1–145; 172/371–372; 81/177.2; 403/DIG. 1

See application file for complete search history.

(56) References Cited

U.S. PATENT DOCUMENTS 381,968 A 5/1888 Tesla
493,858 A 3/1893 Edison
(Continued)

FOREIGN PATENT DOCUMENTS

FR 823395 1/1938
(Continued)

OTHER PUBLICATIONS

"BNS Series-Compatible Series AES Safety Controllers"pp. 1-17, http://www.schmersalusa.com/safety_controllers/drawings/aes.pdf (downloaded on or before Jan. 23, 2009).

(Continued)

*Primary Examiner* — Ramon M Barrera
(74) *Attorney, Agent, or Firm* — Keith W. Saunders; William J. Tucker

(57) ABSTRACT

Tool attachments and extensions handles may be removably connected to each other. In an example embodiment, a tool attachment is capable of being connected to an extension handle having an extension handle connector, which includes a first field emission structure. The tool attachment has a tool implement and a tool attachment connector, which includes a second field emission structure. The tool attachment connector is adapted to be mated to the extension handle connector with the second field emission structure in proximity to the first field emission structure such that the first and second field emission structures have a predetermined alignment with respect to one another. Each of the first and second field emission structures include multiple Field emission sources having positions and polarities relating to a predefined spatial force function that corresponds to the predetermined alignment of the first and second field emission structures within a field domain.

20 Claims, 20 Drawing Sheets

U.S. PATENT DOCUMENTS

| | | | | |
|---|---|---|---|---|
| 996,933 | A | | 7/1911 | Lindquist |
| 1,236,234 | A | | 8/1917 | Troje |
| 2,389,298 | A | | 11/1945 | Ellis |
| 2,570,625 | A | | 10/1951 | Zimmerman et al. |
| 2,697,642 | A | * | 12/1954 | Rudy ..... 403/410 |
| 2,722,617 | A | | 11/1955 | Cluwen et al. |
| 2,932,545 | A | | 4/1960 | Foley |
| 3,102,314 | A | | 9/1963 | Alderfer |
| 3,208,296 | A | | 9/1965 | Baermann |
| 3,288,511 | A | | 11/1966 | Tavano |
| 3,468,576 | A | | 9/1969 | Beyer et al. |
| 3,474,366 | A | | 10/1969 | Barney |
| 3,802,034 | A | | 4/1974 | Bookless |
| 4,079,558 | A | | 3/1978 | Gorham |
| 4,222,489 | A | | 9/1980 | Hutter |
| 4,453,294 | A | | 6/1984 | Morita |
| 4,547,756 | A | | 10/1985 | Miller et al. |
| 4,629,131 | A | | 12/1986 | Podell |
| 4,941,236 | A | | 7/1990 | Sherman |
| 5,050,276 | A | | 9/1991 | Pemberton |
| 5,367,891 | A | | 11/1994 | Furuyama |
| 5,383,049 | A | | 1/1995 | Carr |
| 5,631,093 | A | | 5/1997 | Perry et al. |
| 5,631,618 | A | | 5/1997 | Trumper et al. |
| 6,072,251 | A | | 6/2000 | Markle |
| 6,170,131 | B1 | | 1/2001 | Shin |
| 6,275,778 | B1 | | 8/2001 | Shimada et al. |
| 6,457,179 | B1 | | 10/2002 | Prendergast |
| 6,607,304 | B1 | | 8/2003 | Lake et al. |
| 6,720,698 | B2 | | 4/2004 | Galbraith |
| 6,847,134 | B2 | | 1/2005 | Frissen et al. |
| 6,862,748 | B2 | | 3/2005 | Prendergast |
| 6,927,657 | B1 | | 8/2005 | Wu |
| 6,971,147 | B2 | | 12/2005 | Halstead |
| 7,066,778 | B2 | | 6/2006 | Kretzschmar |
| 7,362,018 | B1 | | 4/2008 | Kulogo et al. |
| 7,444,683 | B2 | | 11/2008 | Prendergast et al. |
| 2004/0003487 | A1 | | 1/2004 | Reiter |
| 2005/0138742 | A1 | * | 6/2005 | Jaszenovics et al. ..... 15/104.94 |
| 2006/0066428 | A1 | | 3/2006 | McCarthy et al. |
| 2006/0189259 | A1 | | 8/2006 | Park |
| 2006/0290451 | A1 | | 12/2006 | Prendergast et al. |
| 2008/0186683 | A1 | | 8/2008 | Ligtenberg et al. |
| 2008/0189870 | A1 | * | 8/2008 | Dayton et al. ..... 7/167 |
| 2008/0272868 | A1 | | 11/2008 | Prendergast et al. |
| 2008/0282517 | A1 | | 11/2008 | Claro |

FOREIGN PATENT DOCUMENTS

| | | | |
|---|---|---|---|
| WO | 2007081830 | A2 | 7/2007 |

OTHER PUBLICATIONS

"Magnetic Safety Sensors"pp. 1-3, http://farnell.com/datasheets/6465.pdf (downloaded on or before Jan. 23, 2009).

"Series BNS-B20 Coded-Magnet Sensor Safety Door Handle" pp. 1-2, http://www.schmersalusa.com/catalog_pdfs/BNS_B20.pdf (downloaded on or before Jan. 23, 2009).

"Series BNS333 Coded-Magnet Sensors with Integrated Safety Control Module" pp. 1-2, http://www.schmersalusa.com/machine_guarding/coded_magnet/drawings/bns333.pdf (downloaded on or before Jan. 23, 2009).

* cited by examiner

FIG. 3B
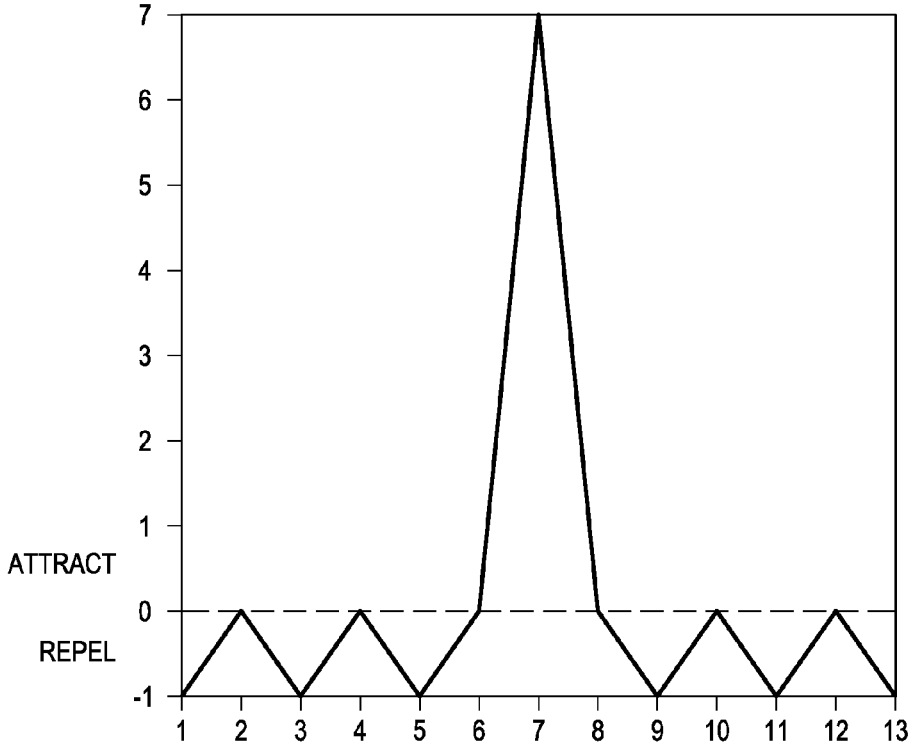
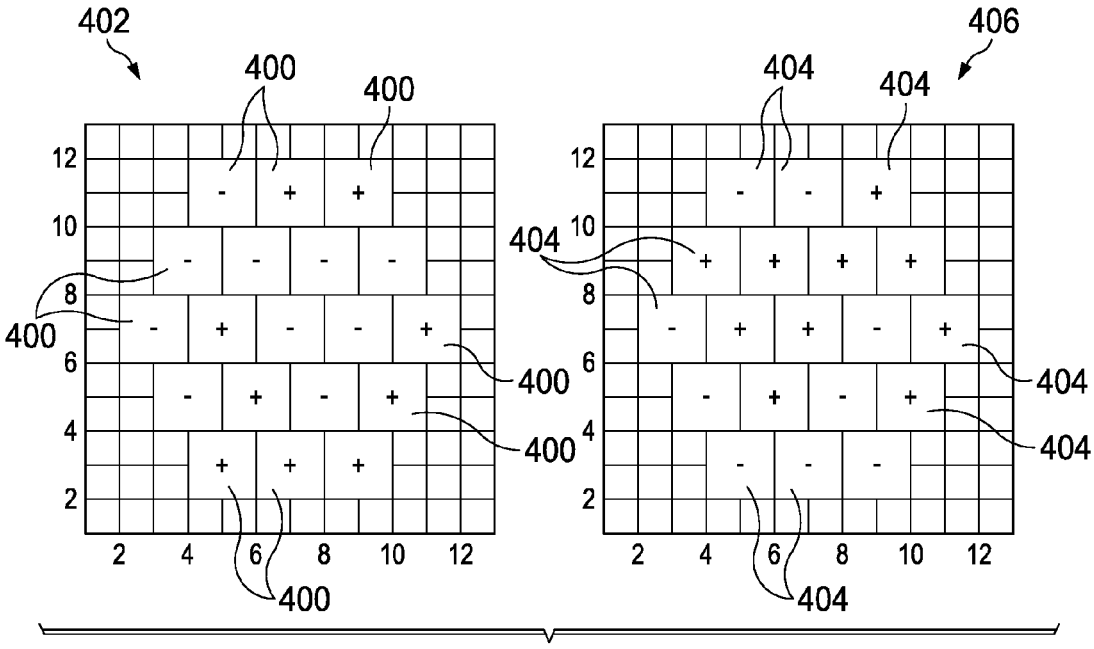
FIG. 4A

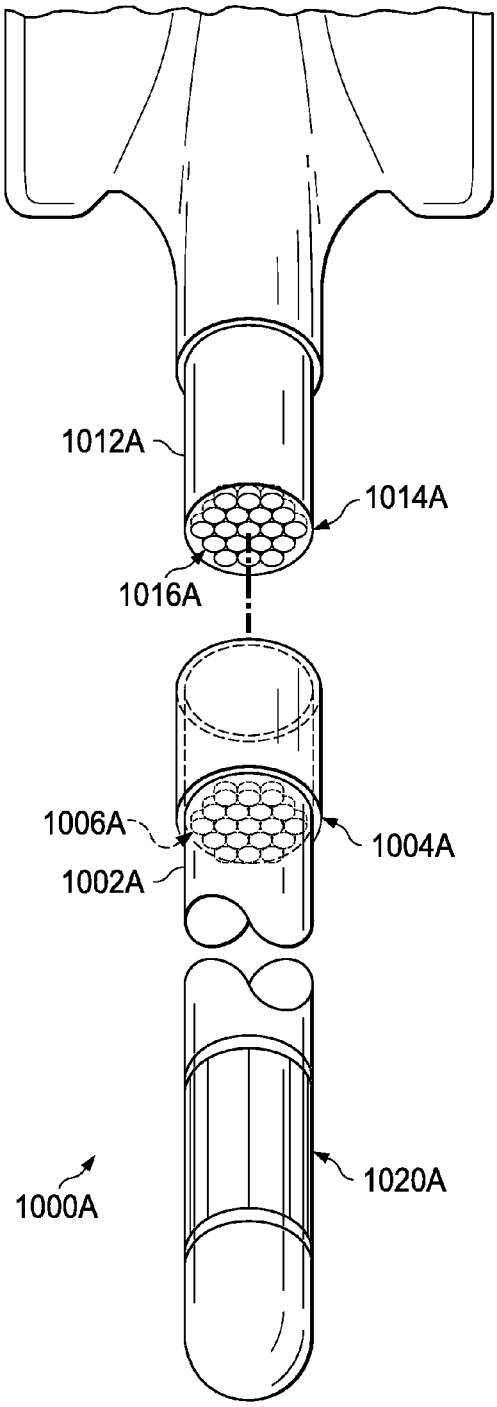
FIG. 10A(1)
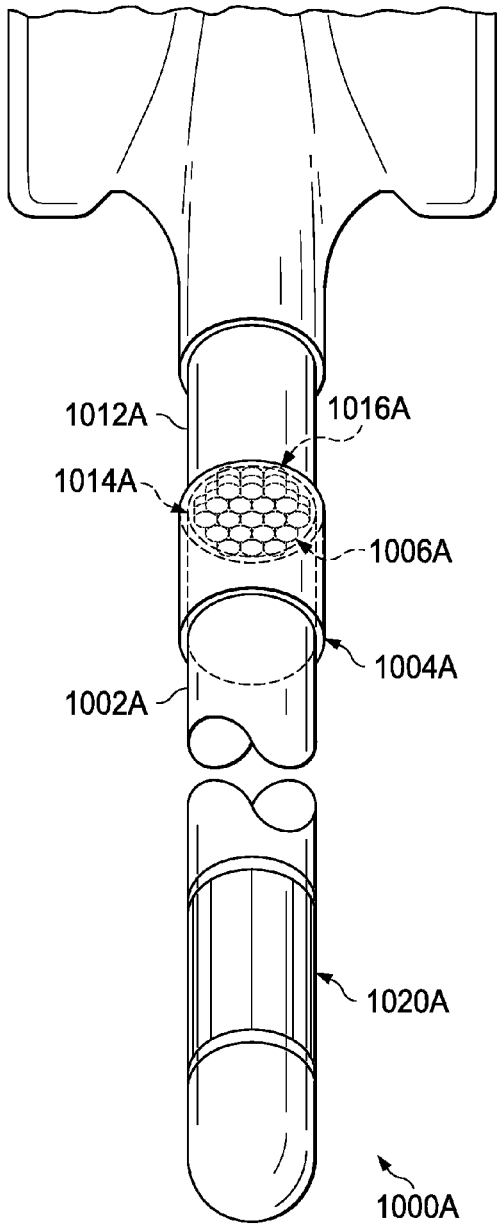
FIG. 10A(2)

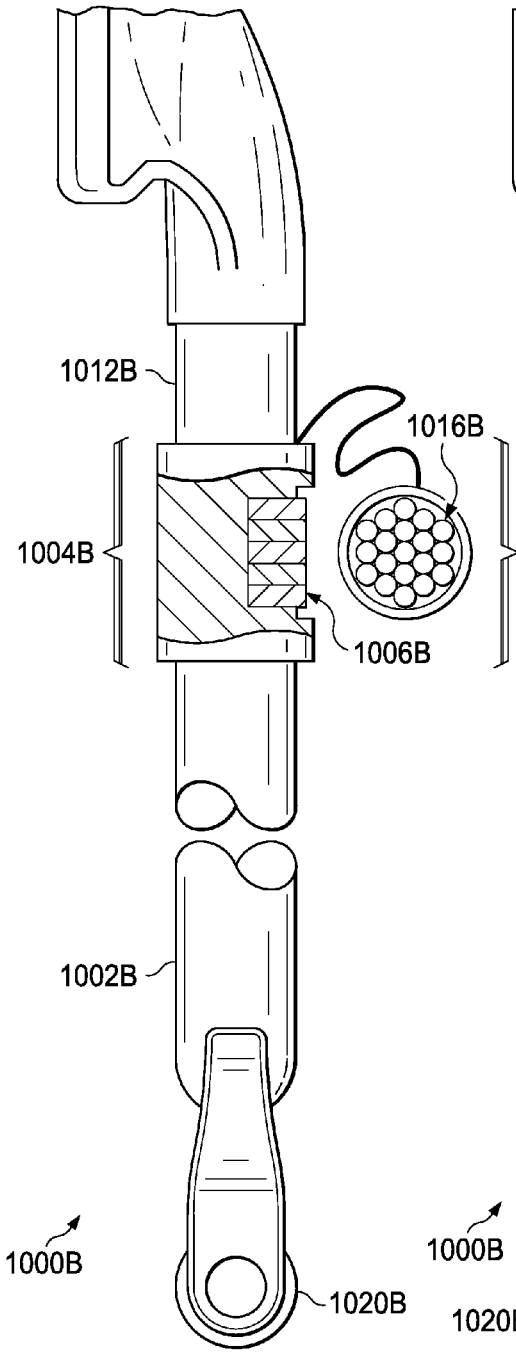
FIG. 10B(1)
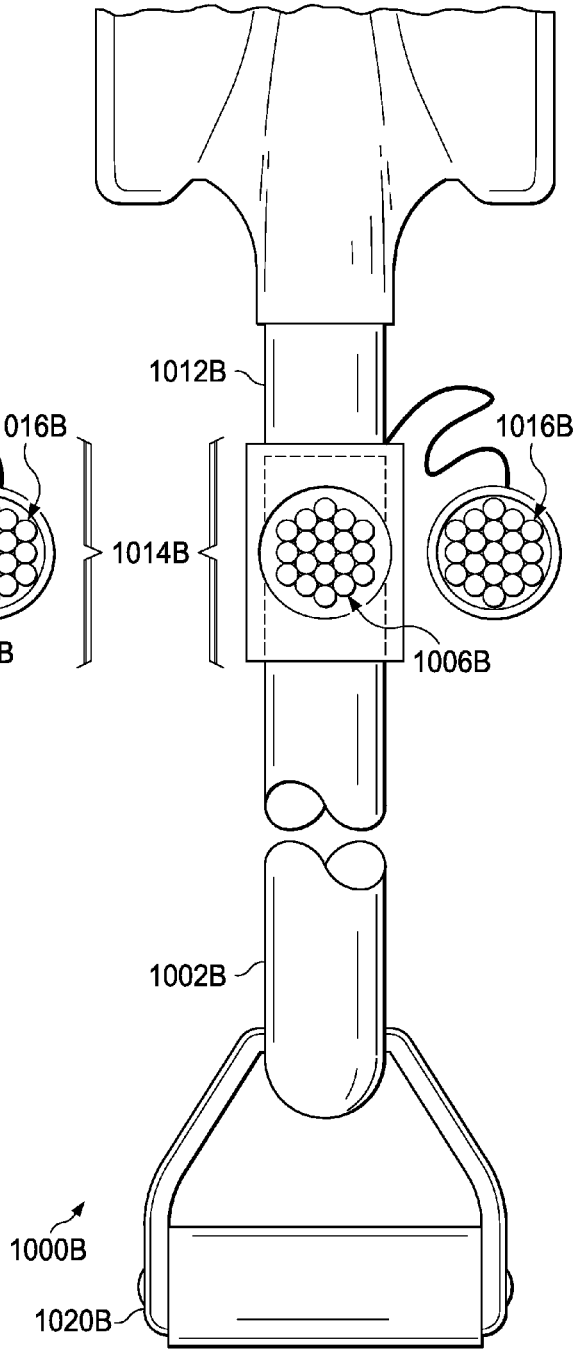
FIG. 10B(2)

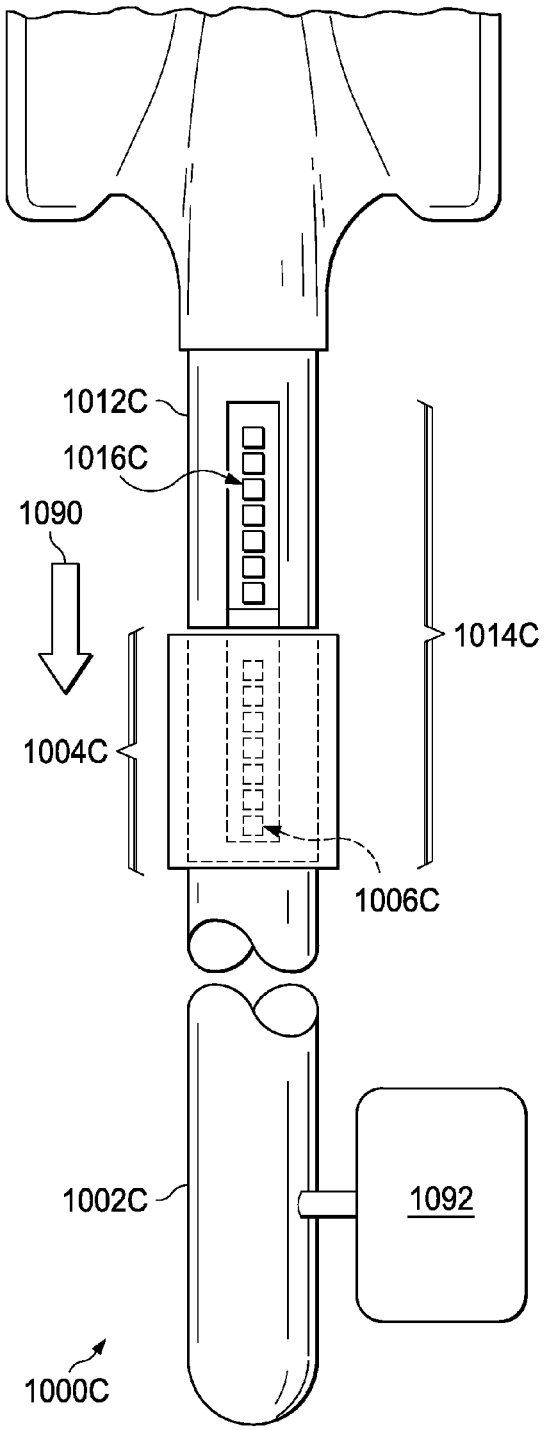
FIG. 10C(1)
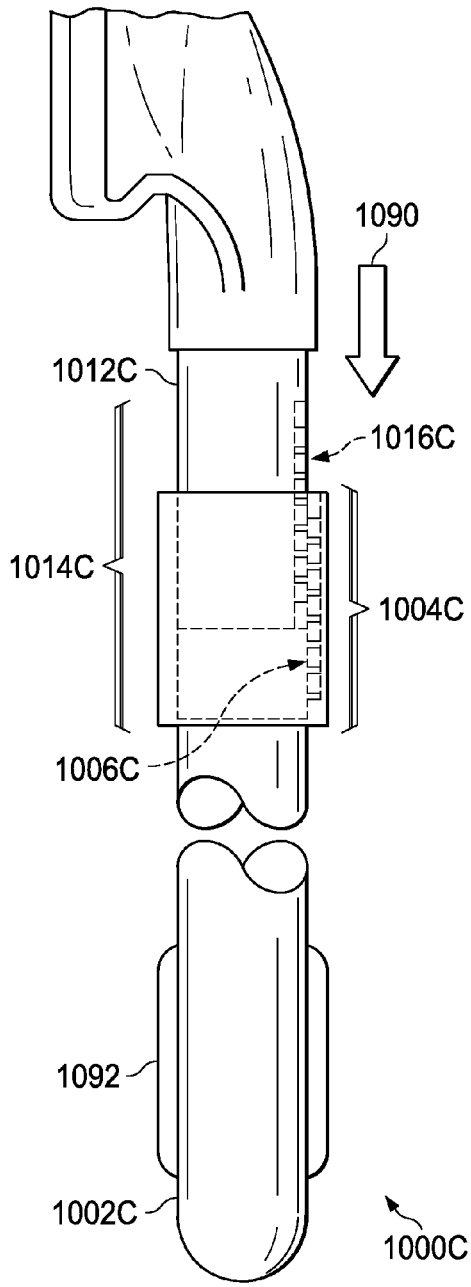
FIG. 10C(2)

APPARATUSES AND METHODS RELATING TO TOOL ATTACHMENTS THAT MAY BE REMOVABLY CONNECTED TO AN EXTENSION HANDLE

CROSS REFERENCES TO RELATED APPLICATIONS

This application is a continuation-in-part application of U.S. patent application Ser. No. 12/476,952 filed on Jun. 2, 2009 and entitled "A Field Emission System and Method", which is a continuation-in-part application of U.S. patent application Ser. No. 12/322,561 filed on Feb. 4, 2009 and entitled "A System and Method for Producing an Electric Pulse", which is a continuation-in-part application of U.S. patent application Ser. No. 12/358,423 filed on Jan. 23, 2009 now U.S. Pat. No. 7,868,721 and entitled "A Field Emission System and Method", which is a continuation-in-part application of U.S. patent application Ser. No. 12/123,718 filed on May 20, 2008 now U.S. Pat. No. 7,800,471 and entitled "A Field Emission System and Method". The contents of these four documents are hereby incorporated herein by reference.

TECHNICAL FIELD

The present invention is related to an apparatus and method that incorporates correlated magnets for removably connecting one or more tool attachments to an extension handle. By way of example but not limitation, a quick-assembly tool may relate to one or more of the following categories: cleaning tool implements, landscaping tool implements, bathroom maintenance tool implements, stability enhancement tool implements, extended-reach tool implements, some combination thereof, and so forth.

DESCRIPTION OF RELATED ART

Most traditional tools are designed to meet a single need, such as sweeping, mopping, trimming grass, cleaning a window, and so forth. Each single-purpose tool is usually adept at meeting its designated need. However, a typical household or business is forced to purchase and store a multitude of such tools. The initial expense and storage space demanded by this paradigm is immense.

In the area of lawn care, some tools with interchangeable parts have been developed. For example, some machines offer tools for trimming and edging that connect to the same hand-held motor. Unfortunately, the mode of attachment for these existing interchangeable tools is woefully inadequate. They are usually attached using a spring-loaded hemispherical metallic ball in one part that pops into a corresponding hole in another part. This mode of attachment is relatively clumsy and difficult to use. It is also imprecise inasmuch as it enables one part to wiggle with respect to the other part. In other words, not only is this existing mode of interchangeable attachment difficult to use, but it also fails to provide sufficient stability.

Thus, it is apparent that conventional single-purpose hand-held tools tend to be expensive and consume significant storage space. Conventional multi-purpose hand-held tools, moreover, are difficult to use and/or feel unstable during their use. These and other deficiencies in the existing art are addressed by one or more of the example embodiments of the invention that are described herein.

SUMMARY

Tool attachments and extensions handles may be removably connected to each other. In an example embodiment, a tool attachment is capable of being connected to an extension handle having an extension handle connector. The extension handle connector includes a first field emission structure. The tool attachment has a tool implement and a tool attachment connector. The tool attachment connector includes a second field emission structure. The tool attachment connector is adapted to be mated to the extension handle connector with the second field emission structure in proximity to the first field emission structure such that the first and second field emission structures have a predetermined alignment with respect to one another. Each of the first and second field emission structures include multiple field emission sources having positions and polarities relating to a predefined spatial force function that corresponds to the predetermined alignment of the first and second field emission structures within a field domain.

In another example embodiment, an apparatus includes an extension handle and a tool attachment. The extension handle has an extension handle connector, with the extension handle connector including a first field emission structure. The tool attachment has a tool attachment connector, with the tool attachment connector including a second field emission structure. The tool attachment connector is adapted to be mated to the extension handle connector with the second field emission structure in proximity to the first field emission structure such that the first and second field emission structures have a predetermined alignment with respect to one another. Each of the first and second field emission structures include multiple field emission sources having positions and polarities relating to a predefined spatial force function that corresponds to the predetermined alignment of the first and second field emission structures within a field domain.

In yet another example embodiment, a method relates to a tool that may be assembled quickly. A first field emission structure is disposed on an extension handle connector of an extension handle. A second field emission structure is disposed on a tool attachment connector of a tool attachment. The tool attachment connector is adapted to be mated to the extension handle connector with the second field emission structure in proximity to the first field emission structure such that the first and second field emission structures have a predetermined alignment with respect to one another. Each of the first and second field emission structures include multiple field emission sources having positions and polarities relating to a predefined spatial force function that corresponds to the predetermined alignment of the first and second field emission structures within a field domain.

Additional embodiments and aspects of the invention are set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed or claimed.

BRIEF DESCRIPTION OF THE DRAWINGS

A more complete understanding of the present invention may be obtained by reference to the following detailed description when taken in conjunction with the accompanying drawings. The individual elements of the drawings are not necessarily illustrated to scale.

FIG. 10A-10C illustrate three example specific embodiments for tool attachments that may be removably connected to an extension handle using correlated magnetic technology.

DETAILED DESCRIPTION

Figure 1:
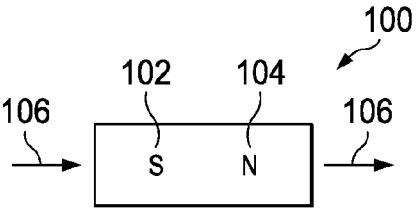
FIGS. 1-9 are various diagrams that are used to help explain different example concepts about correlated magnetic technology, which can be utilized in certain embodiments of the present invention.

Certain embodiments of the present invention relate to quick assembly tools that include an extension handle and a tool attachment. Each of the extension handle and the tool attachment incorporate at least one correlated magnetic structure that enables the tool attachment to be removably connected to the extension handle. Quick assembly tools may be used for many purposes. Example purposes for quick assembly tools include, but are not limited to, cleaning, landscaping, bathroom maintenance, walking support, extended-reach tasks, combinations thereof, and so forth. More specific examples include, but are not limited to, a broom, a mop, and a dust pan; a trimmer, an edger, and a pruner; a toilet brush and a plunger; a cane with friction-assisted supports; a light-bulb changer and a ceiling fan duster; and so forth. Certain embodiments of the present invention are made possible, at least in part, by utilizing an emerging, revolutionary technology that is termed herein "correlated magnetics".

This revolutionary technology referred to herein as correlated magnetics was first fully described and enabled in the co-assigned U.S. patent application Ser. No. 12/123,718 filed on May 20, 2008 and entitled "A Field Emission System and Method". The contents of this document are hereby incorporated herein by reference. A second generation of a correlated magnetic technology is described and enabled in the co-assigned U.S. patent application Ser. No. 12/358,423 filed on Jan. 23, 2009 and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009 and entitled "A Field Emission System and Method". The contents of this document are hereby incorporated herein by reference. Another technology known as correlated inductance, which is related to correlated magnetics, has been described and enabled in the co-assigned U.S. patent application Ser. No. 12/322,561 filed on Feb. 4, 2009 and entitled "A System and Method for Producing and Electric Pulse". The contents of this document are hereby incorporated herein by reference. A brief description of correlated magnetics is provided below first. Thereafter, example embodiments are described for utilizing correlated magnetics to enable tools to be quickly assembled when connecting a tool attachment to an extension handle.

Correlated Magnetics Technology

This section is provided to review basic magnets and to introduce aspects of the new and revolutionary correlated magnetic technology. This section includes subsections relating to basic magnets, correlated magnets, and correlated electromagnetics. It should be understood that this section is provided to assist the reader with understanding the present invention by explaining basic concepts of correlated magnetics and by presenting a set of examples—it should not be used to limit the scope of the present invention.

A. Magnets

A magnet is a material or object that produces a magnetic field which is a vector field that has a direction and a magnitude (also called strength). Referring to FIG. 1, there is illustrated an exemplary magnet 100 which has a South pole 102 and a North pole 104 and magnetic Field vectors 106 that represent the direction and magnitude of the magnet's moment. The magnet's moment is a vector that characterizes the overall magnetic properties of the magnet 100. For a bar magnet, the direction of the magnetic moment points from the South pole 102 to the North pole 104. The North and South poles 104 and 102 are also referred to herein as positive (+) and negative (−) poles, respectively.

Figure 2A:
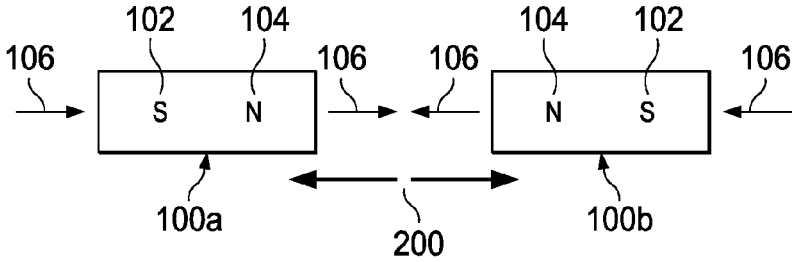
Figure 2B:
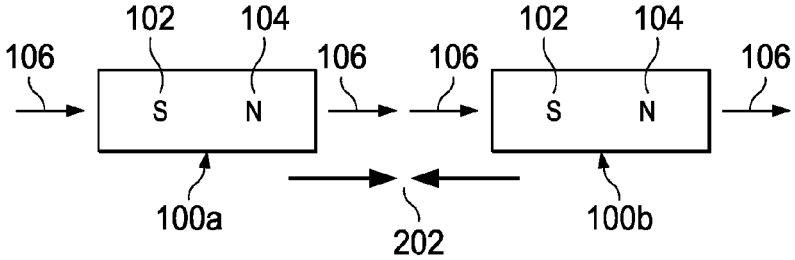
Figure 2C:
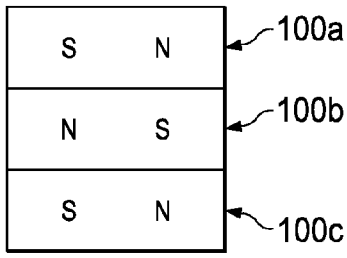

Referring to FIG. 2A, there is a diagram that depicts two magnets 100*a* and 100*b* aligned such that their polarities are opposite in direction resulting in a repelling spatial force 200 which causes the two magnets 100*a* and 100*b* to repel each other. In contrast, FIG. 2B is a diagram that depicts two magnets 100*a* and 100*b* aligned such that their polarities are in the same direction resulting in an attracting spatial force 202 which causes the two magnets 100*a* and 100*b* to attract each other. In FIG. 2B, the magnets 100*a* and 100*b* are shown as being aligned with one another but they can also be partially aligned with one another where they could still "stick" to each other and maintain their positions relative to each other. FIG. 2C is a diagram that illustrates how magnets 100*a*, 100*b*, and 100*c* will naturally stack on one another such that their poles alternate.

B. Correlated Magnets

Correlated magnets can be created in a wide variety of ways depending on the particular application as described in the aforementioned U.S. patent application Ser. Nos. 12/123,718, 12/358,432, and 12/476,952 by using a combination of magnet arrays (referred to herein as magnetic field emission sources that form magnetic field emission structures), correlation theory (commonly associated with probability theory and statistics) and coding theory (commonly associated with communication systems). A brief discussion is provided next to explain how these widely diverse technologies are utilized in a novel way to create correlated magnets.

Generally, correlated magnets may be made from a combination of magnetic (or electric) field emission sources which have been configured in accordance with a pre-selected code having desirable correlation properties. Thus, when a magnetic field emission structure is brought into alignment with a complementary, or mirror image, magnetic field emission structure the various magnetic field emission sources will align causing a peak spatial attraction force to be produced, while a misalignment of the magnetic field emission structures cause the various magnetic field emission sources to substantially cancel each other out in a manner that is a function of the particular code used to design the two magnetic field emission structures. In contrast, when a magnetic field emission structure is brought into alignment with a duplicate magnetic field emission structure then the various magnetic field emission sources align causing a peak spatial repelling force to be produced, while a misalignment of the magnetic field emission structures causes the various magnetic field emission sources to substantially cancel each other out in a manner that is a function of the particular code used to design the two magnetic field emission structures.

The aforementioned spatial forces (attraction, repelling) have a magnitude that is a function of the relative alignment of two magnetic field emission structures and their corresponding spatial force (or correlation) function, the spacing (or distance) between the two magnetic field emission structures, and the magnetic field strengths and polarities of the various sources making up the two magnetic field emission structures. The spatial force functions may be used, for example, to achieve precision alignment and precision positioning that are not possible with basic magnets. Moreover, the spatial force functions can enable the precise control of magnetic fields and associated spatial forces thereby enabling, for example: (i) new forms of attachment devices and mechanisms for attaching objects with precise alignment and (ii) new systems and methods for controlling precision movement of objects. An additional characteristic associated with correlated magnets relates to a situation where the various magnetic field sources making-up two magnetic field emission structures can effectively cancel each other out when they are brought out of alignment, which is described herein as a release force. This release force is a direct result of the particular correlation coding used to configure the magnetic field emission structures.

A person skilled in the art of coding theory will recognize that there are many different types of codes that have different correlation properties, some of which have been used in communications for channelization purposes, energy spreading, modulation, and other purposes. Many of the basic characteristics of such codes make them applicable for use in producing the magnetic field emission structures described herein. For example, Barker codes are known for their autocorrelation properties and can be used to help configure correlated magnets. Although a Barker code is used in an example below with respect to FIGS. 3A-3B, other forms of codes which may or may not be well known in the communications or other arts are also applicable to correlated magnets because of their autocorrelation, cross-correlation, or other properties. Example codes include, but are not limited to, Gold codes, Kasami sequences, hyperbolic congruential codes, quadratic congruential codes, linear congruential codes, Welch-Costas array codes, Golomb-Costas array codes, pseudorandom codes, chaotic codes, Optimal Golomb Ruler codes, deterministic codes, designed codes, one dimensional codes, two dimensional codes, three dimensional codes, or four dimensional codes, combinations thereof, and so forth.

Figure 3A:
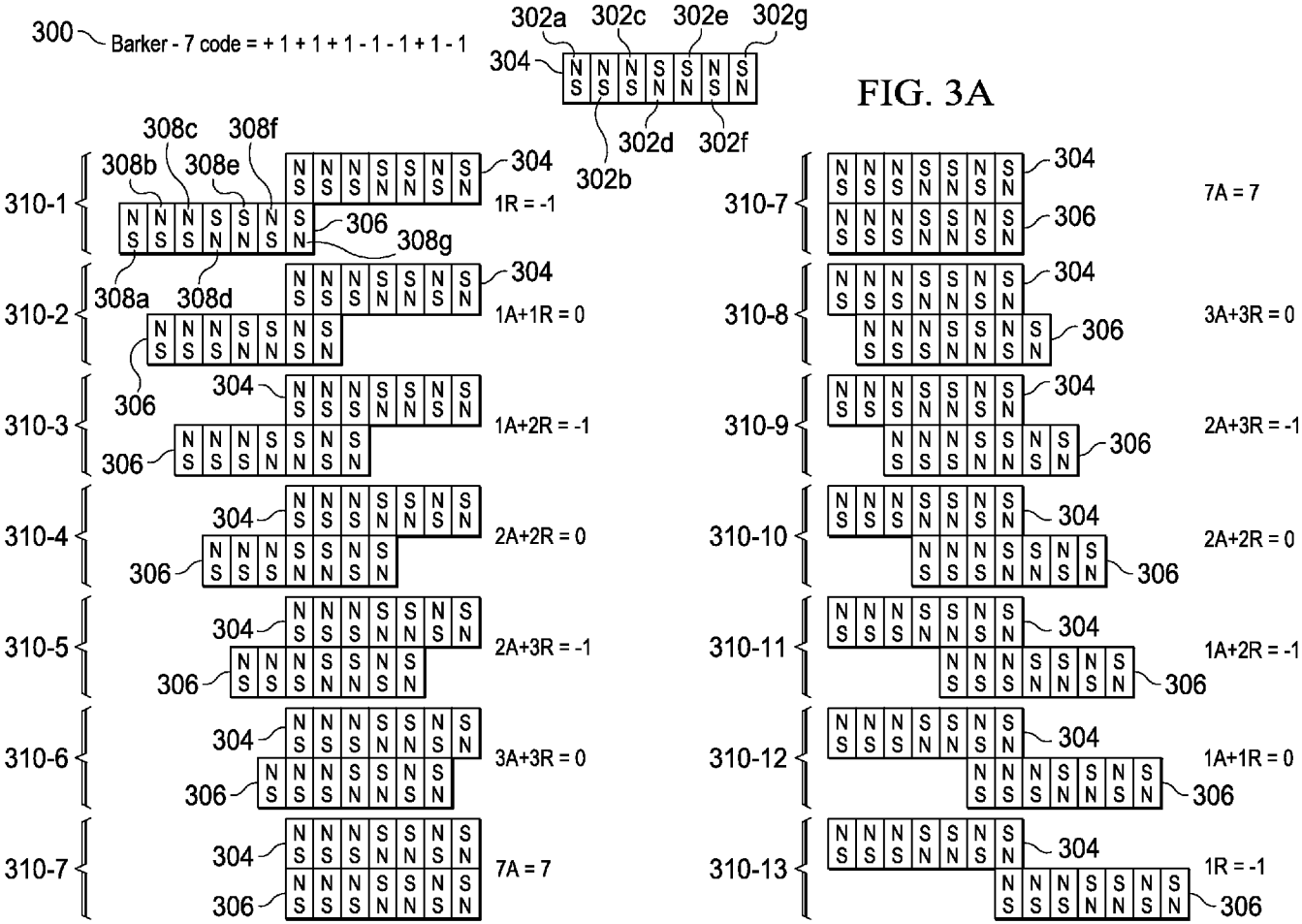

Referring to FIG. 3A, there are diagrams used to explain how a Barker length 7 code 300 can be used to determine polarities and positions of magnets 302*a*, 302*b* . . . 302*g* making up a first magnetic field emission structure 304. Each magnet 302*a*, 302*b* . . . 302*g* has the same or substantially the same magnetic field strength (or amplitude), which for the sake of this example is provided as a unit of 1 (where A=Attract, R=Repel, A=−R, A=1, R=−1). It should be noted, however, that different field emission sources within a single given field emission structure may have different field strengths (e.g., +1, −1, +2, −2, +3, −4, etc.). A second magnetic field emission structure 306 (including magnets 308*a*, 308*b* . . . 308*g*) that is identical to the first magnetic field emission structure 304 is shown in 13 different alignments 310-1 through 310-13 relative to the first magnetic field emission structure 304. For each relative alignment, the number of magnets that repel plus the number of magnets that attract is calculated, where each alignment has a spatial force in accordance with a spatial force function based upon the correlation function and magnetic field strengths of the magnets 302*a*, 302*b* . . . 302*g* and 308*a*, 308*b* . . . 308*g*.

With the specific Barker code example that is used, the spatial force varies from −1 to 7, where the peak occurs when the two magnetic field emission structures 304 and 306 are aligned, which occurs when their respective codes are aligned. The off peak spatial force, referred to as a side lobe force, varies from 0 to −1. As such, the spatial force function causes the magnetic field emission structures 304 and 306 to generally repel each other unless they are aligned such that each of their magnets are correlated with a complementary magnet (i.e., a magnet's South pole aligns with another magnet's North pole, or vice versa). In other words, the two magnetic field emission structures 304 and 306 substantially correlate with one another when they are aligned to substantially mirror each other.

In FIG. 3B, there is a plot that depicts the spatial force function of the two magnetic field emission structures 304 and 306 which results from the binary autocorrelation function of the Barker length 7 code 300, where the values at each alignment position 1 through 13 correspond to the spatial force values that were calculated for the thirteen alignment positions 310-1 through 310-13 between the two magnetic field emission structures 304 and 306 depicted in FIG. 3A. As the true autocorrelation function for correlated magnet field structures is repulsive, and many of the uses currently envisioned have attractive correlation peaks, the usage of the term 'autocorrelation' herein refers to complementary correlation unless otherwise stated. That is, the interacting faces of two such correlated magnetic field emission structures 304 and 306 will be complementary to (i.e., mirror images of) each other. This complementary autocorrelation relationship can be seen in FIG. 3A where the bottom face of the first magnetic field emission structure 304 having the pattern 'S S S N N S N' is shown interacting with the top face of the second magnetic field emission structure 306 having the pattern 'N N N S S N S', which is the mirror image (pattern) of the bottom face of the first magnetic field emission structure 304.

Figure 4B:
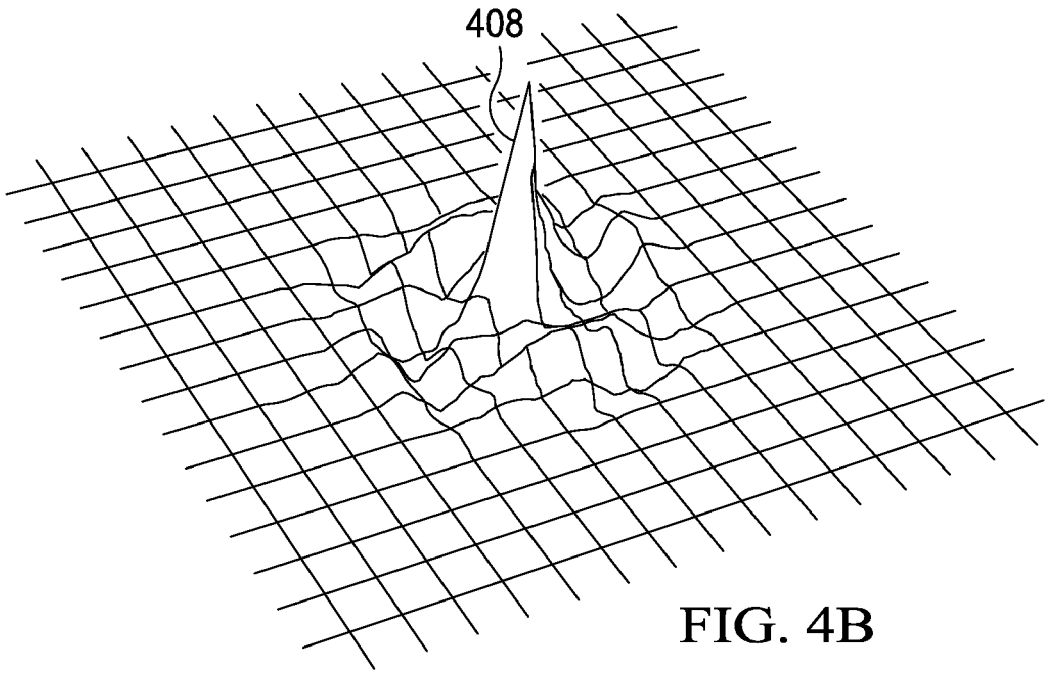
Figure 4C:
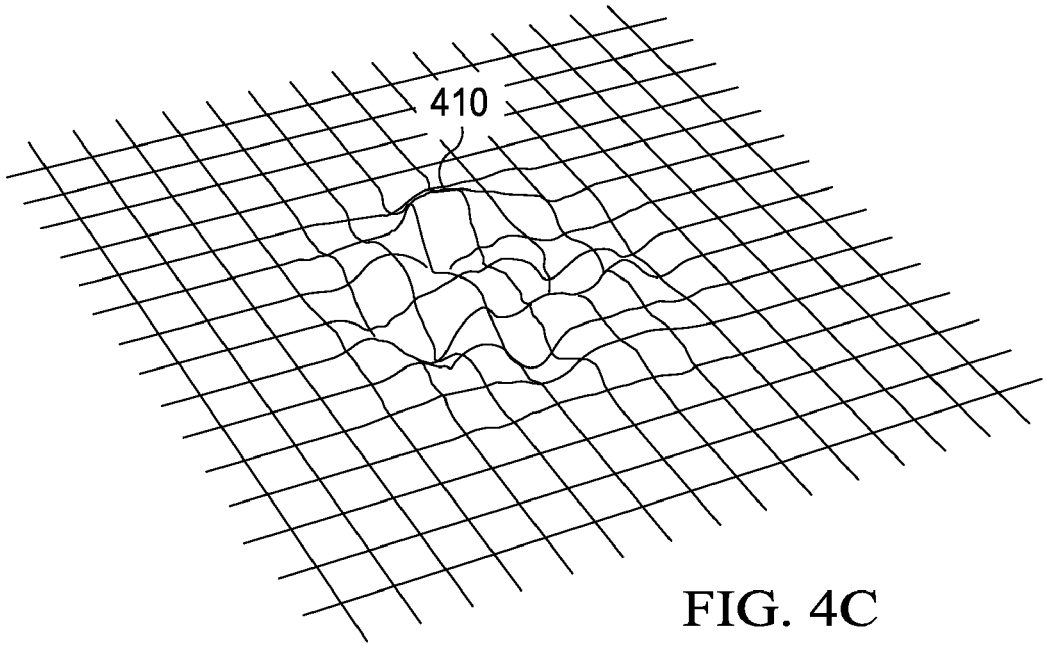

Referring to FIG. 4A, there is a diagram of an array of 19 magnets 400 positioned in accordance with an exemplary code to produce an exemplary magnetic field emission structure 402 and another array of 19 magnets 404 which is used to produce a mirror image magnetic field emission structure 406. In this example, the exemplary code is intended to produce the first magnetic field emission structure 402 to have a first stronger lock when aligned with its mirror image magnetic field emission structure 406 and a second weaker lock when it is rotated 90° relative to its mirror image magnetic field emission structure 406. FIG. 4B depicts a spatial force function 408 of the magnetic field emission structure 402 interacting with its mirror image magnetic field emission structure 406 to produce the first stronger lock. As can be seen, the spatial force function 408 has a peak which occurs when the two magnetic field emission structures 402 and 406 are substantially aligned. FIG. 4C depicts a spatial force function 410 of the magnetic field emission structure 402 interacting with its mirror magnetic field emission structure 406 after being rotated 90°. As can be seen, the spatial force function 410 has a smaller peak which occurs when the two magnetic field emission structures 402 and 406 are substantially aligned but one structure is rotated 90°. If the two magnetic field emission structures 402 and 406 are in other positions, then they can be easily separated given this exemplary code.

Figure 5:
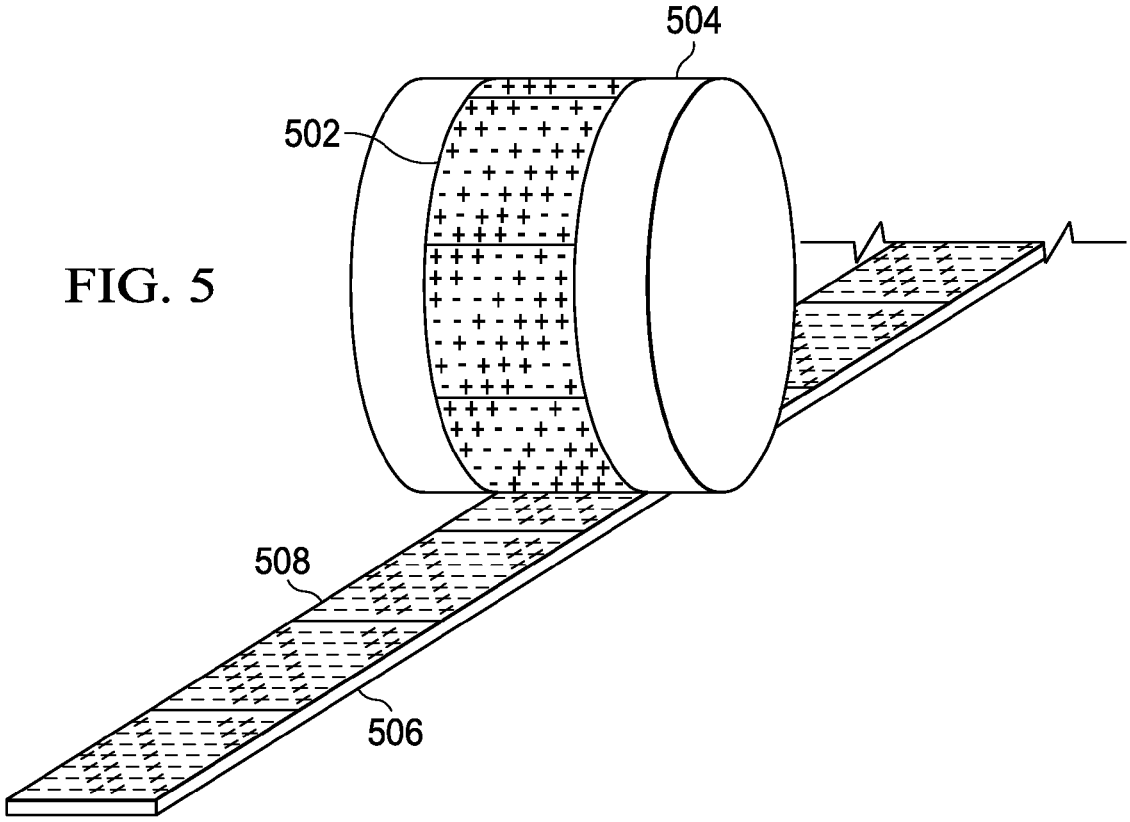

Referring to FIG. 5, there is a diagram depicting a correlating magnet surface 502 being wrapped back on itself on a cylinder 504 (or disc 504, wheel 504) and a conveyor belt/tracked structure 506 having located thereon a mirror image correlating magnet surface 508. In this case, the cylinder 504 can be turned clockwise or counter-clockwise by some force so as to roll along the conveyor belt/tracked structure 506. The fixed magnetic field emission structures 502 and 508 provide a traction and gripping (i.e., holding) force as the cylinder 504 is turned by some other mechanism (e.g., a motor). The gripping force can remain substantially constant as the cylinder 504 moves down the conveyor belt/tracked structure 506 independent of friction or gravity and can therefore be used to move an object about a track that extends up a wall, across a ceiling, or in any other desired direction within the limits of the gravitational force (as a function of the weight of the object) overcoming the spatial force of the aligning magnetic field emission structures 502 and 508. If desired, this cylinder 504 (or other rotary devices) can also be operated against other rotary correlating surfaces to provide a gear-like operation. Since the hold-down force equals the traction force, these gears can be loosely connected and still give positive, non-slipping rotational accuracy. Plus, the magnetic field emission structures 502 and 508 can have surfaces which are perfectly smooth and still provide positive, non-slip traction. In contrast to legacy friction-based wheels, the traction force provided by the magnetic field emission structures 502 and 508 can be largely independent of the friction forces between the traction wheel and the traction surface and can be employed with low friction surfaces. Devices moving about based on magnetic traction can be operated independently of gravity, for example in weightless conditions including space, underwater, vertical surfaces and even upside down.

Figure 6:
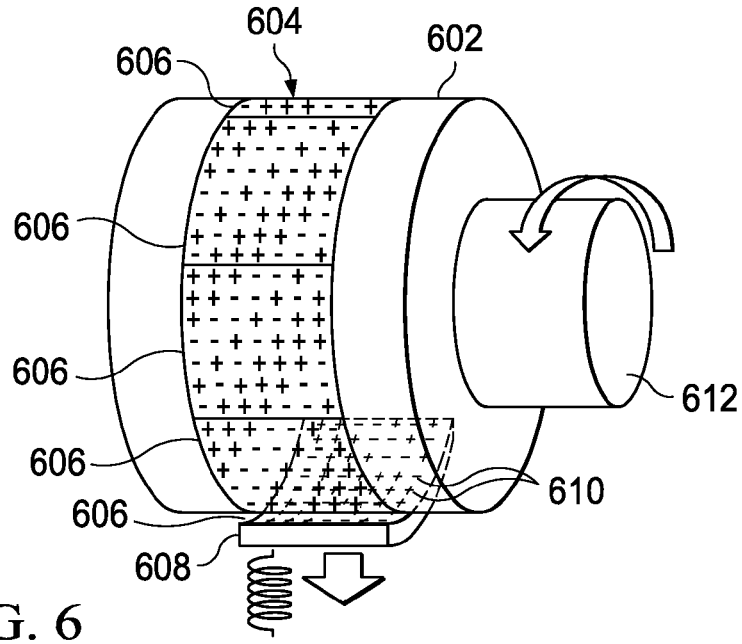

Referring to FIG. 6, there is a diagram depicting an exemplary cylinder 602 having wrapped thereon a first magnetic field emission structure 604 with a code pattern 606 that is repeated six times around the outside of the cylinder 602. Beneath the cylinder 602 is an object 608 having a curved surface with a slightly larger curvature than the cylinder 602 and having a second magnetic field emission structure 610 that is also coded using the code pattern 606. Assume the cylinder 602 is turned at a rotational rate of one rotation per second by shaft 612. Thus, as the cylinder 602 turns, six times a second the first magnetic field emission structure 604 on the cylinder 602 aligns with the second magnetic field emission structure 610 on the object 608 causing the object 608 to be repelled (i.e., moved downward) by the peak spatial force function of the two magnetic field emission structures 604 and 610. Similarly, had the second magnetic field emission structure 610 been coded using a code pattern that mirrored code pattern 606, then six times a second the first magnetic field emission structure 604 of the cylinder 602 would align with the second magnetic field emission structure 610 of the object 608 causing the object 608 to be attracted (i.e., moved upward) by the peak spatial force function of the two magnetic field emission structures 604 and 610. Thus, the movement of the cylinder 602 and the corresponding first magnetic field emission structure 604 can be used to control the movement of the object 608 having its corresponding second magnetic field emission structure 610.

One skilled in the art will recognize that the cylinder 602 may be connected to a shaft 612 which may be turned as a result of wind turning a windmill, water turning a water wheel or turbine, ocean wave movement, and other methods whereby movement of the object 608 can result in some source of energy scavenging. Thus, as described with particular reference to FIGS. 5 and 6, correlated magnetics enables the spatial forces between objects to be precisely controlled in accordance with their movement and also enables the movement of objects to be precisely controlled in accordance with such spatial forces.

In the above examples, the correlated magnets 304, 306, 402, 406, 502, 508, 604 and 610 overcome the normal 'magnet orientation' behavior with the aid of a holding mechanism such as an adhesive, a screw, a bolt & nut, friction forces, static control with a material forming a solid, some combination thereof, and so forth. In other cases, magnet sources of the same magnetic field emission structure can be sparsely separated from other magnets (e.g., in a sparse array) such that the magnetic forces of the individual magnet sources do not substantially interact, in which case the polarity of individual magnet sources can be varied in accordance with a code without requiring a holding mechanism to prevent magnetic forces from 'flipping' a magnet. However, magnets are typically close enough to one another such that their magnetic forces would substantially interact to cause at least one of them to 'flip' so that their moment vectors align, but these magnets can be made to remain in a desired orientation by use of one or more of the above-listed or other holding mechanisms. As such, correlated magnets often utilize some sort of holding mechanism to form different magnetic field emission structures which can be used in a wide-variety of applications like, for example, a turning mechanism, a tool insertion slot, alignment marks, a latch mechanism, a pivot mechanism, a swivel mechanism, a lever, a drill head assembly, a hole cutting tool assembly, a machine press tool, a gripping apparatus, a slip ring mechanism, a structural assembly, combinations thereof, and so forth.

C. Correlated Electromagnetics

Correlated magnets can entail the use of electromagnets which is a type of magnet in which the magnetic field is produced by the flow of an electric current. The polarity of the magnetic field is determined by the direction of the electric current and the magnetic field disappears when the current ceases. Following are a couple of examples in which arrays of electromagnets are used to produce a first magnetic field emission structure that is moved over time relative to a second magnetic field emission structure which is associated with an object thereby causing the object to move.

Figure 7:
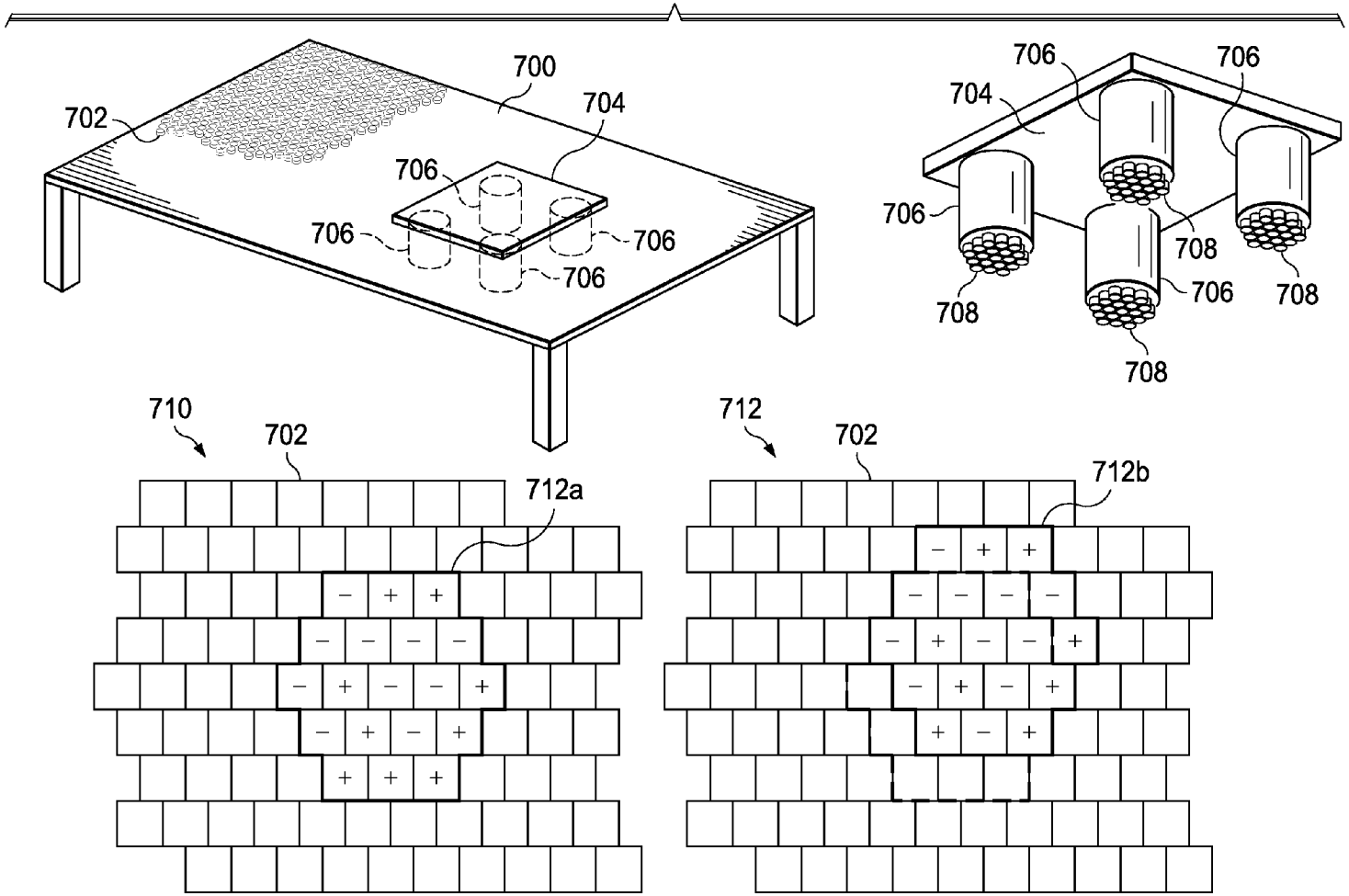

Referring to FIG. 7, there are several diagrams used to explain a 2-D correlated electromagnetics example in which there is a table 700 having a two-dimensional electromagnetic array 702 (first magnetic field emission structure 702) beneath its surface and a movement platform 704 having at least one table contact member 706. In this example, the movement platform 704 is shown having four table contact members 706 each having a magnetic field emission structure 708 (second magnetic field emission structures 708) that would be attracted by the electromagnetic array 702. Computerized control of the states of individual electromagnets of the electromagnet array 702 determines whether they are on or off and determines their polarity. A first example 710 depicts slates of the electromagnetic array 702 configured to cause one of the table contact members 706 to attract to a subset 712*a* of the electromagnets within the magnetic field emission structure 702. A second example 712 depicts different states of the electromagnetic array 702 configured to cause the one table contact member 706 to be attracted (i.e., move) to a different subset 712*b* of the electromagnets within the field emission structure 702. Per the two examples, one skilled in the art can recognize that the table contact member(s) 706 can be moved about table 700 by varying the states of the electromagnets of the electromagnetic array 702.

Figure 8:
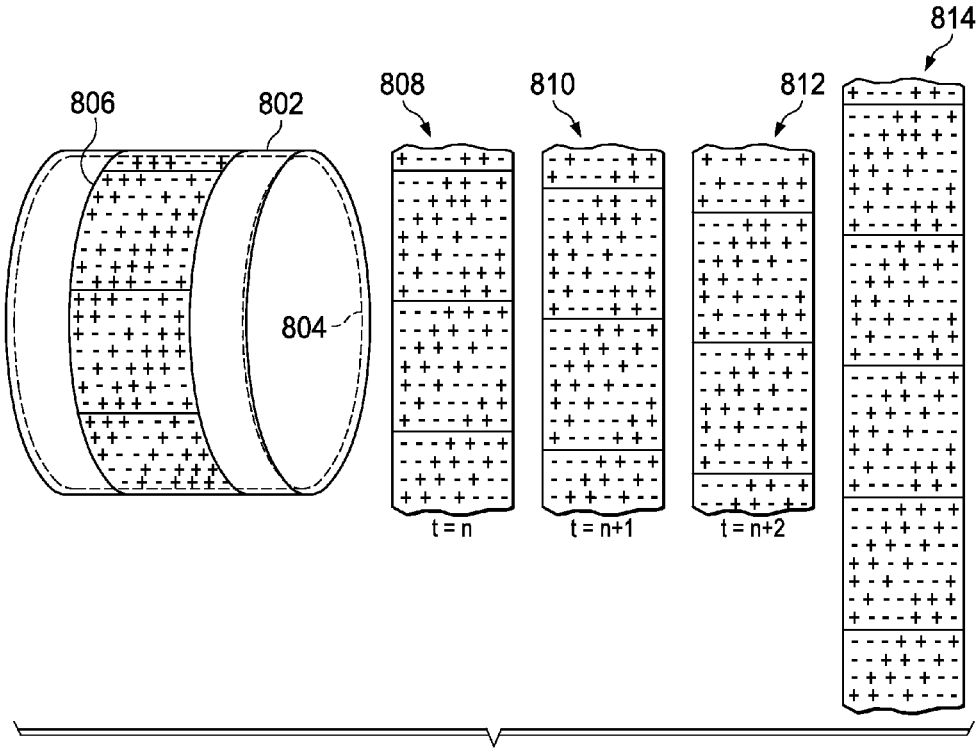

Referring to FIG. 8, there are several diagrams used to explain a 3-D correlated electromagnetics example where there is a first cylinder 802 which is slightly larger than a second cylinder 804 that is contained inside the first cylinder 802. A magnetic field emission structure 806 is placed around the first cylinder 802 (or optionally around the second cylinder 804). An array of electromagnets (not shown) is associated with the second cylinder 804 (or optionally the first cylinder 802) and their states are controlled to create a moving mirror image magnetic field emission structure to which the magnetic field emission structure 806 is attracted so as to cause the first cylinder 802 (or optionally the second cylinder 804) to rotate relative to the second cylinder 804 (or optionally the first cylinder 802). The magnetic field emission structures 808, 810, and 812 produced by the electromagnetic array on the second cylinder 804 at time t=n, t=n+1, and t=n+2, show a pattern mirroring that of the magnetic field emission structure 806 around the first cylinder 802. The pattern is shown moving downward in time so as to cause the first cylinder 802 to rotate counterclockwise. As such, the speed and direction of movement of the first cylinder 802 (or the second cylinder 804) can be controlled via state changes of the electromagnets making up the electromagnetic array. Also depicted in FIG. 8 there is an electromagnetic array 814 that corresponds to a track that can be placed on a surface such that a moving mirror image magnetic field emission structure can be used to move the first cylinder 802 backward or forward on the track using the same code shift approach shown with magnetic field emission structures 808, 810, and 812 (compare to FIG. 5).

Figure 9:
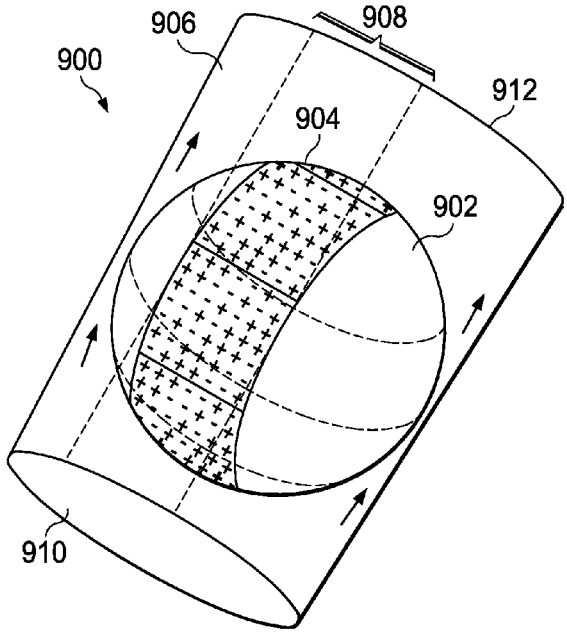

Referring to FIG. 9, there is illustrated an exemplary valve mechanism 900 based upon a sphere 902 (having a magnetic field emission structure 904 wrapped thereon) which is located in a cylinder 906 (having an electromagnetic field emission structure 908 located thereon). In this example, the electromagnetic field emission structure 908 can be varied to move the sphere 902 upward or downward in the cylinder 906 which has a first opening 910 with a circumference less than or equal to that of the sphere 902 and a second opening 912 having a circumference greater than the sphere 902. This configuration is desirable since one can control the movement of the sphere 902 within the cylinder 906 to control the flow rate of a gas or liquid through the valve mechanism 900. Similarly, the valve mechanism 900 can be used as a pressure control valve.

Furthermore, the ability to move an object within another object having a decreasing size enables various types of sealing mechanisms that can be used for the sealing of windows, refrigerators, freezers, food storage containers, boat hatches, submarine hatches, etc., where the amount of sealing force can be precisely controlled. One skilled in the art will recognize that many different types of seal mechanisms that include gaskets, o-rings, and the like can be employed with the use of the correlated magnets. Plus, one skilled in the art will recognize that the magnetic field emission structures can have an array of emission sources including, for example, a permanent magnet, an electromagnet, an electret, a magnetized ferromagnetic material, a portion of a magnetized ferromagnetic material, a soft magnetic material, or a superconductive magnetic material, some combination thereof, and so forth.

Correlated Magnetic Apparatuses and Methods for Quick-Assembly Tools

Figure 10:
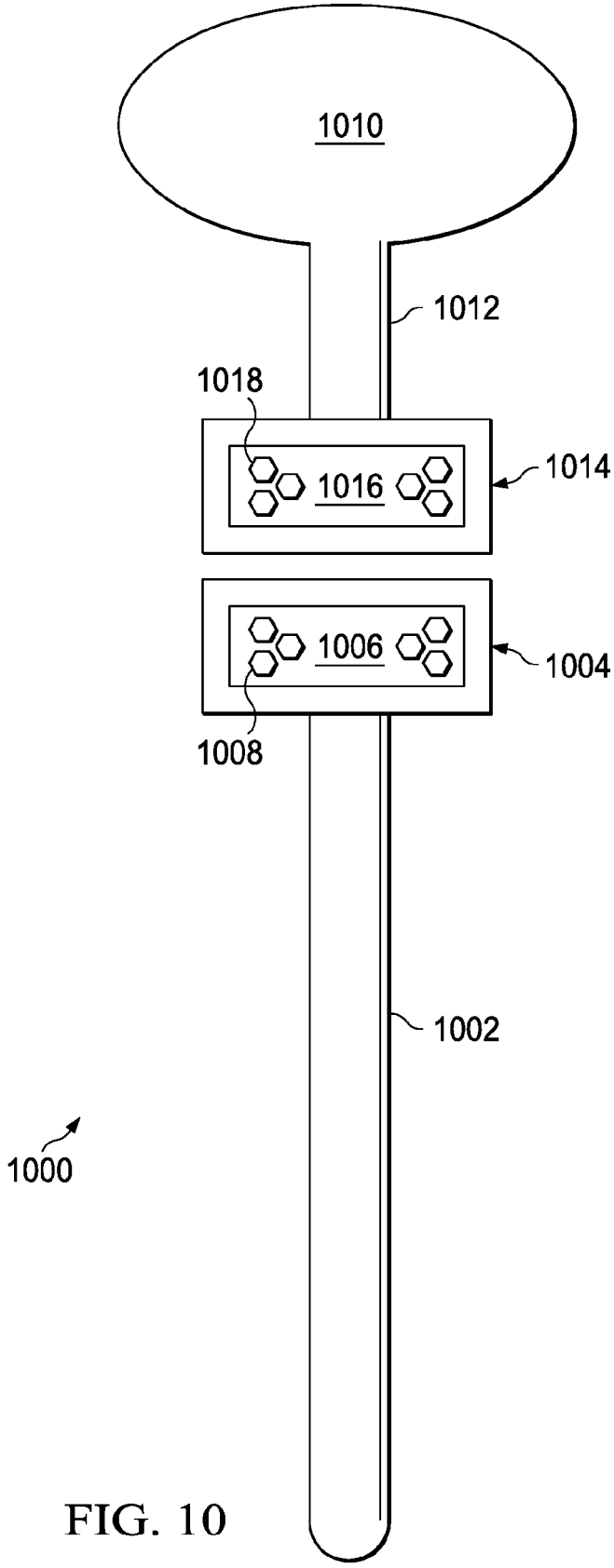
FIG. 10 illustrates an example general embodiment for tool attachments that may be removably connected to an extension handle using correlated magnetic technology.

FIG. 10 illustrates an example general embodiment for tool attachments 1012 that may be removably connected to an extension handle 1002 using correlated magnetic technology. As illustrated, an apparatus (e.g., a quick-assembly tool 1000) includes an extension handle 1002 and a tool attachment 1012. Extension handle 1002 comprises an extension handle connector 1004 that includes a first field emission structure 1006. Tool attachment 1012 comprises a tool attachment connector 1014 that includes a second field emission structure 1016. Tool attachment 1012 also comprises a tool implement 1010.

In an example embodiment, an apparatus includes an extension handle 1002 and a tool attachment 1012. Extension handle 1002 has an extension handle connector 1004, with extension handle connector 1004 including a first field emission structure 1006. Tool attachment 1012 has a tool attachment connector 1014, with tool attachment connector 1014 including a second field emission structure 1016. Extension handle 1002 may be connected to tool attachment 1012 by mating extension handle connector 1004 to tool attachment connector 1014. Tool implement 1010 is adapted to aid in the accomplishment of some task or tasks (e.g., cleaning, landscaping, walking, maintaining a facility, etc.).

In an example implementation, tool attachment connector 1014 is adapted to be mated to extension handle connector 1004 with second field emission structure 1016 in proximity to first field emission structure 1006 such that the first and second field emission structures 1006 and 1016 have a predetermined alignment with respect to one another. Moreover, each of the first and second field emission structures 1006 and 1016 include multiple field emission sources 1008 and 1018, respectively, having positions and polarities relating to a predefined spatial force function that corresponds to the predetermined alignment of the first and second field emission structures 1006 and 1016 within a field domain.

Field emission sources (e.g., 302, 308, 400, 404, 1008, 1018, etc.) having designated positive and negative polarity field emissions are configured as part of and to thereby form a field emission structure in accordance with at least one code. The at least one code is selected to establish a correlation between two (or more) field emission structures that can achieve a desired spatial force responsive to a predefined spatial force function. The predefined spatial force function results from two field emission structures being placed in proximity and moved into a predetermined relative alignment with respect to each other. During such relative movement between two field emission structures, a particular field emission source (e.g., of a first field emission structure) having a given polarity may become proximate to a first field emission source (e.g., of a second field emission structure) having the same given polarity as the particular field emission source and proximate to a second field emission source (e.g., of the second field emission structure) having an opposite polarity to that of the particular field emission source until the predetermined relative alignment is achieved. In this manner, the particular field emission source may experience both attractive and repulsive forces from different opposing field emission sources during the relative movement.

Generally, extension handle 1002 enables an extended reach for using tool attachment 1012 away from the core of a person's body. Extension handle 1002 may be solid or hollow (e.g., to enable fluid, electrical, mechanical, or other communication internally along the length of the extension handle).

Quick-assembly tool 1000 may be utilized in many different environments. Example environments include, but are not limited to: residential, commercial, business, and industrial locations; inside building structures and outside around building structures; in yards and other natural areas; around and inside vehicles; combinations thereof; and so forth.

Example realizations for extension handles 1002, tool attachments 1012, tool implements 1010, etc. are described further herein below, particularly with reference to FIGS. 10A-10C and 14-18. Example realizations for extension handle connectors 1004 and tool attachment connectors 1014 are described further herein below, particularly with reference to FIGS. 10A-10C, 12, and 13. Example realizations for first field emission structures 1006 and second field emission structures 1016 are described further herein, particularly with reference to FIGS. 3A, 4A, 10A-10C, and 11A-11I.

FIGS. 10A-10C illustrate three specific example embodiments for tool attachments that may be removably connected to an extension handle using correlated magnetic technology. More specifically, different example embodiments for extension handle connectors 1004A-C and tool attachment connectors 1014A-C are shown in FIGS. 10A-10C, respectively. Generally, a given extension handle connector 1004 is adapted to mate with a corresponding tool attachment connector 1014. Different example embodiments for first field emission structures 1006A-C and second field emission structures 1016A-C are also shown in FIGS. 10A-10C, respectively.

FIGS. 10A(1) and 10A(2) illustrate an apparatus (e.g., a quick-assembly tool 1000A) that includes an extension handle 1002A and a tool attachment 1012A. As illustrated, extension handle 1002A comprises an extension handle connector 1004A that includes a first field emission structure 1006A. Tool attachment 1012A comprises a tool attachment connector 1014A that includes a second field emission structure 1016A. Extension handle 1002A also includes a gripping instrument 1020A. Although shown as a circular hand grip surrounding extension handle 1002A, gripping instrument 1020A may be implemented in alternative manners when it is present.

For an example embodiment, extension handle 1002A is shown as a smooth and straight member having a substantially-circular cross-section. Extension handles 1002 may, however, be implemented differently. By way of example but not limitation, the extended length of an extension handle 1002 may be arced or curved in one or more directions at one or more locations. It may also have at least one actual bend. The cross-section may be other than circular, such as rectangular, hexagonal, combinations thereof, and so forth. An extension handle 1002 may also be textured and/or include other non-illustrated parts that facilitate its use to accomplish an intended task. Similarly, a tool attachment 1012 may be implemented differently from what is illustrated; for example, it may be realized with curves, bends, other cross-sections, textures, other non-illustrated parts, some combination thereof, and so forth.

For an example embodiment of quick-assembly tool 1000A, extension handle connector 1004A is adapted to mate with tool attachment connector 1014A. Extension handle connector 1004A includes a receptacle or cowl that accepts at least a portion of tool attachment connector 1014A. First field emission structure 1006A is configured to match second field emission structure 1016A. When extension handle connector 1004A is mated to tool attachment connector 1014A, first field emission structure 1006A and second field emission structure 1016A may be moved relative to one another to secure tool attachment 1012A to extension handle 1002A. For instance, first field emission structure 1006A may be rotatably moved relative to second field emission structure 1016A. An example interaction that involves a rotational movement between first and second field emission structures 1006A and 1016A is described herein below with particular reference to FIGS. 11A-11I.

One field emission structure may be considered to match another field emission structure when, for example, they are capable of being aligned and misaligned by their relative movement when they are in proximity to each other. More specifically, two field emission structures may be considered matching when a predetermined amount of alignment results in a predefined spatial force function that achieves a predefined spatial force between the two field emission structures. A total current predefined spatial force may be attractive, repulsive, or some combination thereof in dependence on the coding used to configure the field emission sources and a current relative alignment between the field emission structures.

Quick-assembly tool 1000A is depicted in FIG. 10A(1) in a disassembled state. It is depicted in FIG. 10A(2) in an assembled state. First field emission structure 1006A is not visible (as shown), and second field emission structure 1016A is visible in the disassembled state of FIG. 10A(1). In the assembled state of FIG. 10A(2), both first and second field emission structures 1006A and 1016A are hidden and are shown with dashed lines. The dashed line portions of tool attachment 1012A indicate that a portion of tool attachment 1012A is located within a portion of extension handle 1002A. Thus, assembling quick-assembly tool 1000A involves inserting a portion of tool attachment 1012A into a portion of extension handle 1002A.

Although a particular embodiment is shown in FIG. 10A and described herein above, other alternatives may be implemented instead. By way of example only, tool attachment connector 1014A may include a receptacle or cowl such that extension handle connector 1004A of extension handle 1002A is inserted into tool attachment connector 1014A of tool attachment 1012A. Also, neither extension handle connector 1004A nor tool attachment connector 1014A may include a receptacle or cowl such that extension handle connector 1004A of extension handle 1002A abuts tool attachment connector 1014A of tool attachment 1012A without significant overlap by either connector.

FIGS. 10B(1) and 10B(2) illustrate an apparatus (e.g., a quick-assembly tool 1000B) that includes an extension handle 1002B and a tool attachment 1012B. As illustrated, extension handle 1002B comprises an extension handle connector 1004B that includes a first field emission structure 1006B. Tool attachment 1012B comprises a tool attachment connector 1014B that includes a second field emission structure 1016B. Extension handle 1002B also includes a gripping instrument 1020B. Although shown as a pull handle grip that extends from extension handle 1002B at an end that is distant from extension handle connector 1004B, gripping instrument 1020B may be implemented in alternative manners. For an example embodiment of quick-assembly tool 1000B, extension handle connector 1004B is adapted to mate with tool attachment connector 1014B. At least a portion of extension handle connector 1004B is designed to fit within a receptacle or cowl of tool attachment connector 1014B. First field emission structure 1006B is configured to match second field emission structure 1016B. When extension handle connector 1004B is mated to tool attachment connector 1014B, first field emission structure 1006B and second field emission structure 1016B may be moved relative to one another to secure tool attachment 1012B to extension handle 1002B. For instance, second field emission structure 1016B may be rotatably moved relative to first field emission structure 1006B. An example interaction that involves rotational movement between first and second field emission structures 1006B and 1016B is described herein below with particular reference to FIGS. 11A-11I.

Quick-assembly tool 1000B is depicted in an assembled state in FIG. 10B. It is depicted in FIG. 10B(1) in a partially cut-away side view and in FIG. 10B(2) in a frontal view. During assembly, at least a portion of extension handle connector 1004B is placed within a receptacle or cowl of tool attachment connector 1014B as shown in FIG. 10B(1). When viewed from the front as shown in FIG. 10B(2), the at least a portion of extension handle connector 1004B that is no longer visible as indicated by the dashed lines. However, it is apparent that first field emission structure 1006B is visible and accessible through an orifice (e.g., aperture) defined by tool attachment connector 1014B. As part of the assembly process, second field emission structure 1016B is placed at least proximate to (e.g., in contact with) first field emission structure 1006B. In this context, one field emission structure may be considered to be proximate to another field emission structure when they are sufficiently close so as to produce a spatial force in accordance with a predefined spatial force function. Also, one field emission structure may be considered to be proximate to another field emission structure at least when they are in physical contact with each other.

The dashed line portions of extension handle 1002B indicate that a portion of extension handle 1002B is located with a portion of tool attachment 1012B. Extension handle connector 1004B is positioned within tool attachment connector 1014B such that first field emission structure 1006B is visible through the orifice. Second field emission structure 1016B may then be placed at least proximate to first field emission structure 1006B so as to secure tool attachment 1012B to extension handle 1002B. Second field emission structure 1016B may be attached to tool attachment 1012B with, for example, a flexible connector (e.g., a string, a rope, twine, a plastic extension, a chain, a bungee cord, etc.). Although the field emission structures shown in FIGS. 10A and 10B are illustrated with 19 field emission sources, this is by way of example only, for they may alternatively include more or fewer than 19 such field emission sources.

Although a particular embodiment is shown in FIG. 10B and described herein above, other alternatives may be implemented instead. By way of example only, extension handle connector 1004B may include a receptacle or cowl such that tool attachment connector 1014B of tool attachment 1012B is inserted into extension handle connector 1004B of extension handle 1002B. In such an implementation, second field emission structure 1016B may be integrated with or otherwise permanently affixed to tool attachment connector 1014B, and first field emission structure 1006B may be flexibly connected to extension handle connector 1004B. As another example, second field emission structure 1016B may be permanently affixed to the inside of the receptacle or cowl of tool attachment connector 1014B. Hence, in such an implementation, a relative twisting motion between extension handle 1002B and tool attachment 1012B enables an appropriate predetermined alignment between first field emission structure 1006B and second field emission structure 1016B to be established to secure the assembled tool.

FIGS. 10C(1) and 10C(2) illustrate an apparatus (e.g., a quick-assembly tool 1000C) that includes an extension handle 1002C and a tool attachment 1012C. As illustrated, extension handle 1002C comprises an extension handle connector 1004C that includes a first field emission structure 1006C. Tool attachment 1012C comprises a tool attachment connector 1014C that includes a second field emission structure 1016C. Extension handle 1002C is also shown to include a facilitating instrument 1092.

Thus, in example embodiments, extension handle 1002C may include at least one facilitating instrument 1092. Facilitating instrument 1092 is associated with extension handle 1002C and may be connected thereto and/or integrated therewith. Facilitating instrument 1092 facilitates the accomplishment of some task that quick-assembly tool 1000C is intended to accomplish. Examples of facilitating instruments 1092 include, but are not limited to, a motor or engine that drives a part of tool attachment 1012C; a reservoir for a fluid to be dispensed during the task, an interface to receive or provide fluid, electrical, etc. communication to tool attachment 1012C; a trigger, a lever, or another actuator to manipulate a part of tool attachment 1012C, and so forth. Although a facilitating instrument 1092 is shown as being located in a particular position, one or more may alternatively be located at other position(s). Facilitating instruments 1092 may also be implemented with any other quick-assembly tool embodiments in addition to those of FIGS. 10C(1) and 10C(2).

For an example embodiment of quick-assembly tool 1000C, extension handle connector 1004C is adapted to mate with tool attachment connector 1014C. At least a portion of tool attachment connector 1014C is designed to fit within a receptacle or cowl of extension handle connector 1004C. First field emission structure 1006C is configured to match second field emission structure 1016C. When extension handle connector 1004C is mated to tool attachment connector 1014C, first field emission structure 1006C and second field emission structure 1016C may be moved relative to one another to secure tool attachment 1012C to extension handle 1002C. For instance, second field emission structure 1016C may be linearly moved relative to first field emission structure 1006C. An example interaction with relative linear movement between two field emission structures 304 and 306 is described herein above with particular reference to FIG. 3A.

Quick-assembly tool 1000C is depicted as undergoing assembly in FIGS. 10C(1) and 10C(2). It is depicted in FIG. 10C(1) in a partially-assembled state in a front view. Quick-assembly tool 1000C is depicted in FIG. 10C(2) in an almost-fully-assembled state in a side view. During assembly, at least a portion of tool attachment connector 1014C is placed within a receptacle or cowl of extension handle connector 1004C as shown by the dashed line extensions for tool attachment connector 1014C in FIGS. 10C(1) and 10C(2). Seven field emission sources form at least part of first field emission structure 1006C, which field emission sources are not visible in the views of FIG. 10C(1) or 10C(2), as indicated by their dashed lines. Second field emission structure 1016C includes seven matching field emission sources that are visible in the view of FIG. 10C(1) but not in that of FIG. 10C(2). Second field emission structure 1016C is capable of being slid in the direction of arrow 1090 to increase the peak spatial force field created by first field emission structure 1006C and second field emission structure 1016C. Although seven field emission sources are shown in FIG. 10C (and in FIG. 3A), each field emission structure may alternatively include more or fewer such field emission sources.

The side view in FIG. 10C(2) is a partial cut-away view along a central plane that divides the field emission sources so that their relative positioning are apparent in the FIGURE. At least a portion of tool attachment connector 1014C (e.g., at least second field emission structure 1016C) is being slid under (as shown, to the left of) the field emission sources of first field emission structure 1006C in the direction of arrow 1090. As part of the assembly process, second field emission structure 1016C is placed at least proximate to (e.g., in contact with) first field emission structure 1006C when at least a portion of tool attachment connector 1014C is placed within a receptacle or cowl of extension handle connector 1004C.

Although a particular embodiment is shown in FIG. 10C and described above, other alternatives may be implemented instead. By way of example only, tool attachment connector 1014C may include a receptacle or cowl such that extension handle connector 1004C of extension handle 1002C is inserted into tool attachment connector 1014C of tool attachment 1012C. In such an implementation, second field emission structure 1016C may be integrated with or otherwise statically affixed to tool attachment connector 1014C, and first field emission structure 1006C may be slidably connected to extension handle connector 1004C. As another alternative, first field emission structure 1006C and second field emission structure 1016C may be positioned "horizontally" around the circumference of extension handle connector 1004C and tool attachment connector 1014C, respectively. Although each of first and second field emission structures would still move linearly relative to each other in such an implementation, the field emission structure that is sliding would be rotating around a central axis of extension handle connector 1004C and/or tool attachment connector 1014C.

It should be understood that die three specific example embodiments or FIGS. 10A-10C are not mutually exclusive. The different illustrated and described aspects and features may be combined, modified, exchanged, etc. in many ways for a given quick-assembly tool 1000. For instance, quick-assembly tool 1000A may include a facilitating instrument 1092, or quick-assembly tool 1000C may include a gripping instrument 1020. Also, a quick-assembly tool 1000 may include connection mechanisms from two or more of the specific example embodiments of FIGS. 10A-10C. For instance, a quick-assembly tool 1000 may be assembled using aspects of the connection mechanisms of both FIGS. 10A and 10B, e.g. for increased stability. In such an implementation, extension handle 1002 is rotated with respect to tool attachment 1012 to increase the spatial force function between first field emission structure 1006A and second field emission structure 1016A. This rotation positions a first field emission structure 1006B at an orifice of tool attachment connector 1014B. A user may then bring second field emission structure 1016B into proximity with first field emission structure 1006B and rotate second field emission structure 1016B relative to first field emission structure 1006B. This second field emission structure pair can reduce the likelihood that extension handle 1002 and tool attachment 1012 may be accidentally rotated relative to each other during strenuous use.

Generally, the field emission structures 1006 and 1016 can have many different configurations and can be formed from field emission sources comprised of many different types of permanent magnets, electromagnets, and/or electro-permanent magnets, and so forth. The size, shape (e.g., besides circles, squares, etc.), emission source strengths, number (e.g., besides seven, 19, etc.) and other characteristics of the field emission sources may be tailored to meet different goals or for different environments. The field emission structures may be configured in accordance with any code. Moreover, the shape of field emission structures may be other than a circle or a line. For example, they may be triangular, rectangular, hexagonal, octagonal, and so forth. They may also be non-solid shapes, such as an "X", a star, and so forth. A field emission structure may also be formed along a perimeter of a shape, such as along the circumference of a circle. Forming a first field emission structure 1006 and a second field emission structure 1016 along a perimeter (e.g., circumference) of an extension handle 1002 and a tool attachment 1012, respectively, would enable a central channel to provide communication between extension handle 1002 and tool attachment 1012. Such a communication channel may be occupied by power wire(s), drive shaft(s), fluid tube(s), a combination thereof, and so forth.

In an example "quick-assembly" operation, first field emission structure 1006 is configured to interact (correlate) with second field emission structure 1016 such that tool attachment 1012 can, when desired, be substantially aligned to become attached (secured) to extension handle 1002 or misaligned to become removed (detached) from extension handle 1002. In particular, extension handle 1002 can be attached to tool attachment 1012 when their respective first and second field emission structures 1006 and 1016 are located proximate to one another and have a certain alignment with respect to one another (e.g., see FIGS. 10 and 10A-10C). In an example implementation, tool attachment 1012 is attached to extension handle 1002 with a desired strength so as to prevent tool attachment 1012 from being inadvertently disengaged from extension handle 1002. Tool attachment 1012 can be released from extension handle 1002 when their respective first and second field emission structures 1016 and 1006 are turned with respect to one another.

The process of attaching and detaching tool attachment 1012 to and from extension handle 1002 is achievable because the first and second field emission structures 1006 and 1016 each comprise an array (e.g., 1-D, 2-D, etc.) of field emission sources 1008 and 1018 (e.g., an array of magnets 1008 and 1018), and each array has sources with positions and polarities relating to a predefined (e.g., desired) spatial force function that corresponds to a predetermined relative alignment of the first and second field emission structures 1006 and 1016 within a field domain (e.g., see above discussion on correlated magnet technology). In this example application for securing tool attachment 1012 to extension handle 1002, the first and second field emissions structures 1006 and 1016 both have the same code, but they are a mirror image of one another (see, e.g., FIGS. 3A, 4A, and 11A-11I). An example of how tool attachment 1012 can be attached (secured) to or removed from extension handle 1002 with correlated magnetics is discussed in detail below with particular reference to FIGS. 11A-11I.

FIGS. 11A-11I are diagrams that illustrate an example of how first and second (e.g., magnetic) field emission structures can be aligned or misaligned relative to each other to secure a tool attachment to an extension handle or enable removal of the tool attachment from the extension handle. Although FIGS. 11A-11I are described with particular reference to the elements of FIGS. 10A(1) and 10A(2), the principles are also applicable to the elements of FIGS. 10B(1) and 10B(2) and to relative rotational movement between two field emission structures generally. There is depicted an exemplary selected first magnetic field emission structure 1006A (associated with extension handle 1002A) and its mirror image second magnetic field emission structure 1016A (associated with tool attachment 1012A, which is not shown in FIG. 11A). Also shown in the form of arrows are the resulting spatial forces produced in accordance with the various alignments as the field emission structures are rotated or twisted relative to each other, which enables one to connect or remove tool attachment 1012A to or from extension handle 1002A.

Figure 11A:
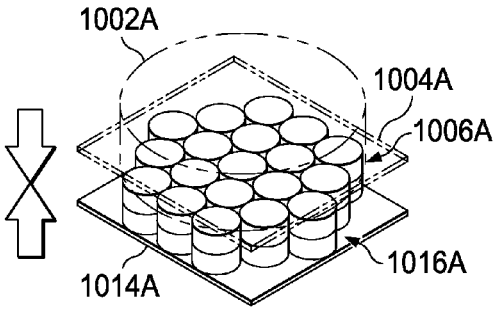
FIGS. 11A-11I are diagrams that illustrate an example of how first and second field emission structures can be aligned or misaligned relative to each other to secure a tool attachment to an extension handle or enable removal of the tool attachment from the extension handle.
Figure 11D:
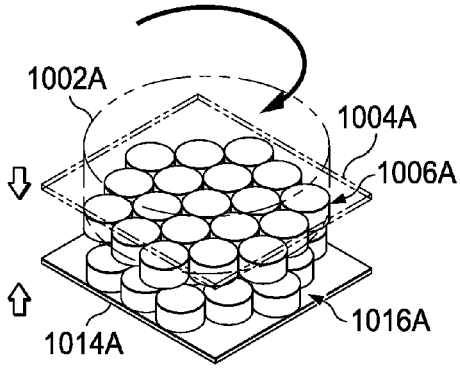
Figure 11B:
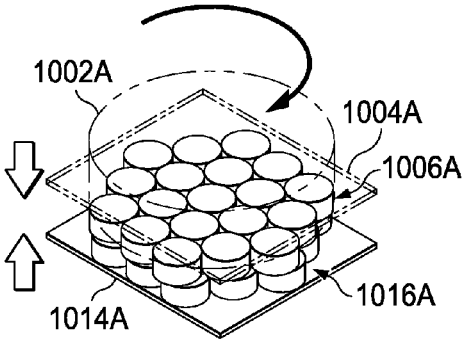

In FIG. 11A, first magnetic field emission structure 1006A (attached to extension handle 1002A at extension handle connector 1004A) and the mirror image second magnetic field emission structure 1016A (of tool attachment connector 1014A) are aligned to produce a peak spatial force. In FIG. 11B, first magnetic field emission structure 1006A is rotated via extension handle connector 1004A clockwise slightly relative to the mirror image second magnetic field emission structure 1016A, and the attractive force reduces significantly. In this example, tool attachment connector 1014A is not rotated, but extension handle 1002A is used to rotate first magnetic field emission structure 1006A (alternatively, the other field emission structure or both field emission structures can be rotated). In FIG. 11C, first magnetic field emission structure 1006A is further rotated via extension handle connector 1004A, and the attractive force continues to decrease. In FIG. 11D, first magnetic field emission structure 1006A is still further rotated until the attractive force becomes very small, such that the two magnetic field emission structures 1006A and 1016A are easily separated as shown in FIG. 11E.

One skilled in the art would also recognize that extension handle 1002 and tool attachment 1012 can also be detached by applying a pull force, shear force, or any other force sufficient to overcome the attractive peak spatial force between the substantially aligned first and second field emission structures 1006 and 1016. However, a shear force can be counterbalanced with a cowl or the sidewalls of a receptacle, such as those illustrated as part of extension handle connector 1004A in FIG. 10A. Also, a pull force can be counterbalanced by additionally employing the mechanism of FIG. 10B as a second set of matching first and second field emission structures 1006B and 1016B.

Figure 11E:
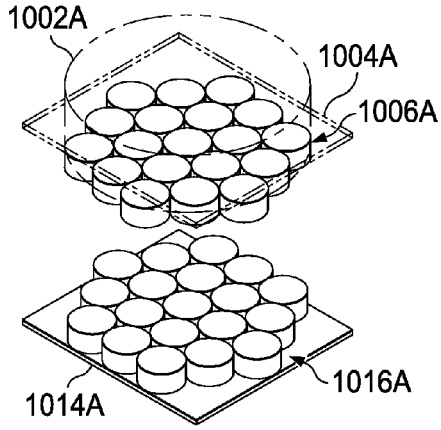
Figure 11C:
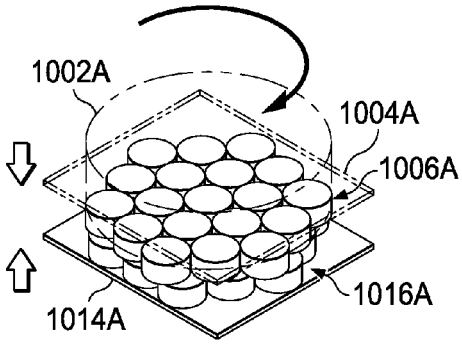
Figure 11F:
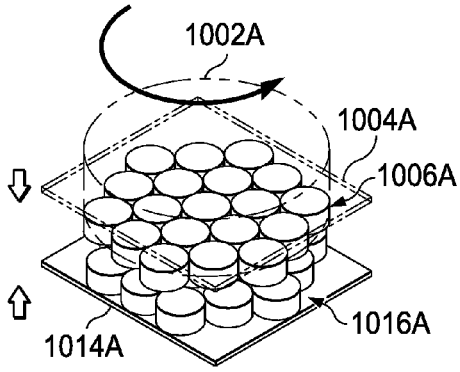
Figure 11G:
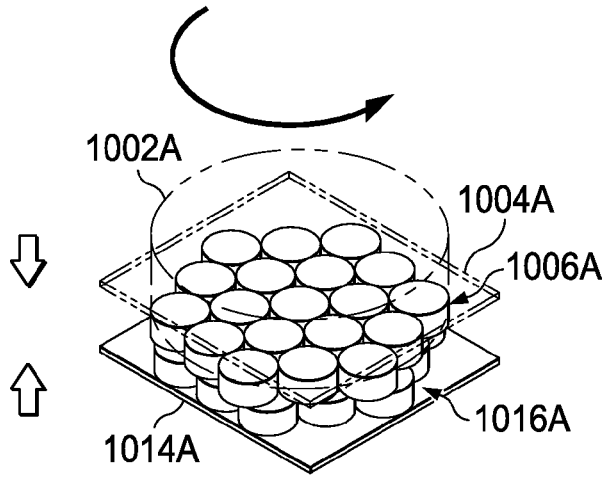
Figure 11H:
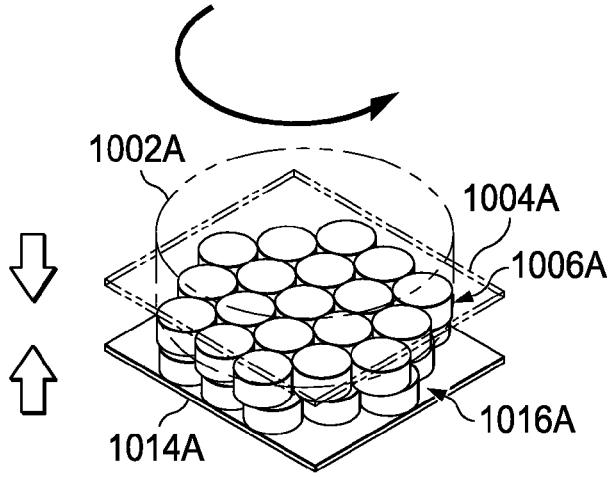
Figure 11I:
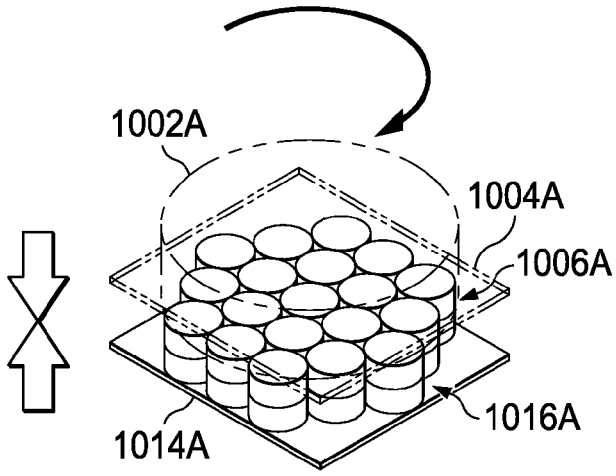

Given that the two magnetic field emission structures 1006A and 1016A are held somewhat apart as in FIG. 11E, the two magnetic field emission structures 1006A and 1016A can be moved closer and rotated towards alignment to produce a small spatial force as in FIG. 11F. The spatial force increases as the two magnetic field emission structures 1006A and 1016A become more and more aligned in FIGS. 11G and 11H, until a peak spatial force is achieved when aligned as in FIG. 11I. It should be noted that the illustrated direction of rotation in FIGS. 11A-11I is arbitrarily chosen, and it may be varied, especially depending on the code employed. Additionally, the first and second magnetic field emission structures 1006A and 1016A are mirror images of one another, which results in an attractive peak spatial force (see also FIGS. 3-4). This mechanism for securing and removing tool attachment 1012 to and from extension handle 1002 is a marked-improvement over the prior art, which requires a great degree of dexterity and patience on the part of the person wishing to assemble a given conventional tool, with the assembled conventional tool ultimately still being somewhat wobbly.

The drawings, including FIGS. 11A-11I, show field emission sources of field emission structures as being disposed at least partially "above" (i.e., beyond) a surface of a given connector. However, they may be disposed in at an alternative altitude. For example, each field emission source may be disposed so as to be recessed at least partially below the surface of the connector. Field emission sources may also be flush with the surface of the connector on which they are disposed. One connector may have recessed field emission sources while a mating connector may have protruding field emission sources. Other combinations may also be implemented. Moreover, different field emission sources within a single field emission structure may be disposed at different altitudes (e.g., protruding, recessed, flush, etc.).

The drawings, including FIGS. 11A-11I, show first and second field emission structures that may be moved relative to one another without any apparent limitation. However, one or more travel limiters may be included to stop and/or retard the relative movements. Examples for travel limiters include, but are not limited to, tabs, protrusions, detents, ridges, combinations thereof, and so forth. A travel limiter may be used, for instance, so that two field emission structures with varying spatial force functions can only be rotated in one direction to attain a peak spatial force function position, the rotational movement would then be reversed to decrease the spatial force function.

Thus, for an example embodiment generally, a user aligns first and second field emission structures 1006 and 1016 such that tool attachment 1012 can be attached to extension handle 1002 when first and second field emission structures 1006 and 1016 are located proximate to one another and have a predetermined alignment with respect to one another such that they correlate with each other to produce a peak attractive spatial force. The user can release tool attachment 1012 from extension handle 1002 by turning first field emission structure 1006 relative to second field emission structure 1016 so as to misalign the two field emission structures 1006 and 1016. This process for assembling and dissembling a tool by attaching and detaching tool attachment 1012 to and from extension handle 1002 is enabled because each of the First and second field emission structures 1006 and 1016 includes an array of field emission sources 1008 and 1018, respectively, each having positions and polarities relating to a predefined spatial force function that corresponds to a relative alignment of the first and second field emission structures 1006 and 1016 within a field domain.

Each field emission source 1008 or 1018 of each array of field emission sources has a corresponding field emission amplitude and vector direction determined in accordance with the desired predefined spatial force function, where a separation distance between the first and second field emission structures 1006 and 1016 and the relative alignment of the first and second field emission structures 1006 and 1016 creates a spatial force in accordance with the predefined spatial force function. The field domain corresponds to first field emissions from the array of first field emission sources 1008 of first field emission structure 1006 interacting with second field emissions from the array of second field emission sources 1018 of second field emission structure 1016.

Figure 12A:
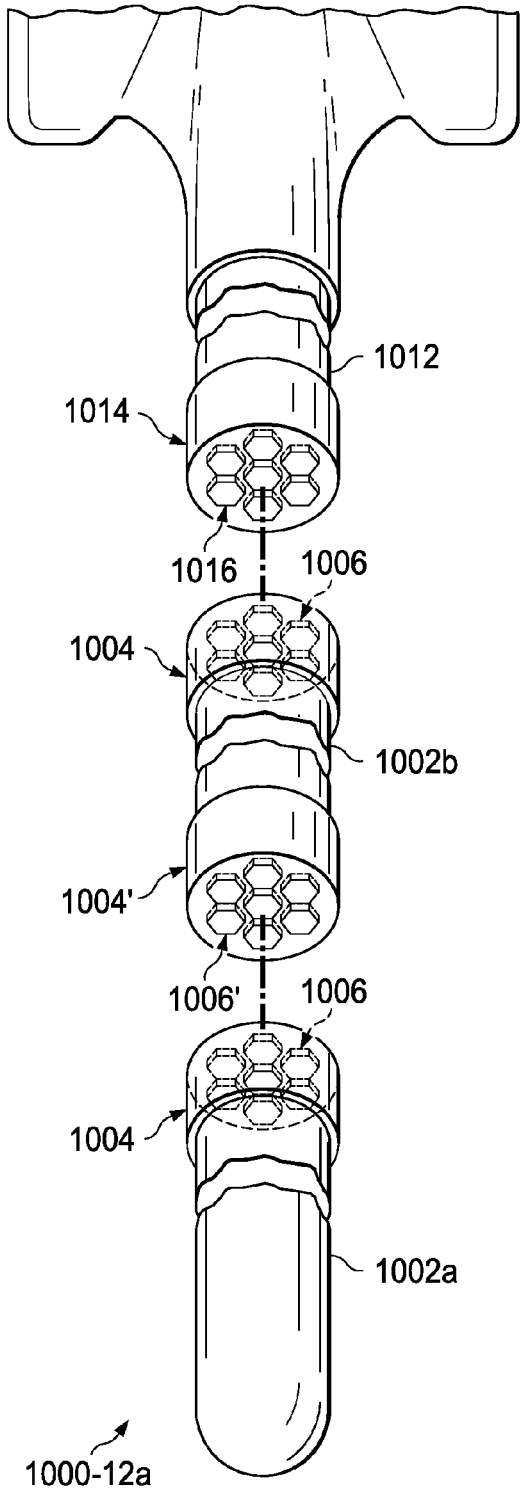
FIGS. 12*a* and 12*b* illustrate two example quick assembly tools having one or more elongated extension handle components to increase a length of an overall extension handle.
Figure 12B:
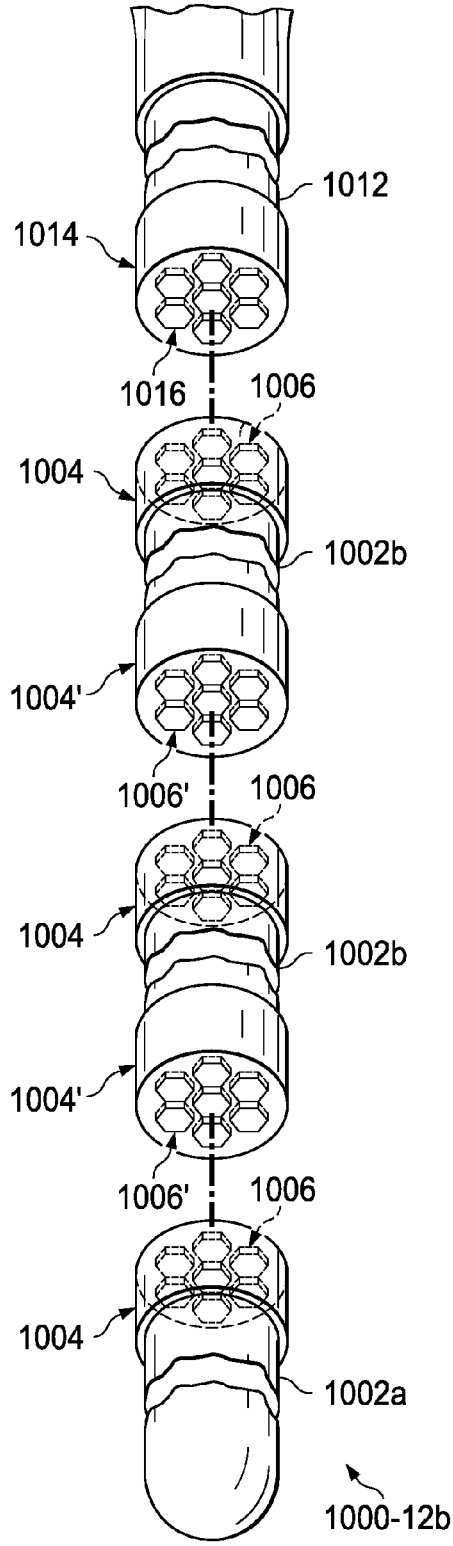

FIGS. 12*a* and 12*b* illustrate example quick assembly tools 1000-12*a* and 100-12*b*, respectively, having multiple extension handle components 1002. As illustrated, a quick-assembly tool 1000-12*a* is depicted in FIG. 12*a* with two extension handles 1002*a* and 1002*b*. A quick-assembly tool 1000-12*b* is depicted in FIG. 12*b* with three extension handles 1002*a*, 1002*b*, and 1002*b*. For example embodiments generally, each extension handle 1002 may comprise multiple extension handle components 1002*a* and/or 1002*b* to enable the overall length of the tool to be changed. Although shown as being physically separable components, multiple extension handles 1002*a* and/or 1002*b* may alternatively be coupled to one another via a folding (e.g., hinged) mechanism, via a telescoping mechanism, a combination thereof, and so forth.

In an example embodiment, extension handle 1002*a* comprises an extension handle connector 1004 that includes a first field emission structure 1006. Each tool attachment 1012 comprises a tool attachment connector 1014 that includes a second field emission structure 1016. These components may be similar or even identical to those that are described herein above with particular reference to FIGS. 10 and 10A-10C. Elongated extension handle 1002*b*, on the other hand, may be configured differently. Although an additional one and two elongated extension handles 1002*b* are shown in FIGS. 12*a* and 12*b* at quick assembly tools 1000-12*a* and 100-12*b*, respectively, more than two (or no) elongated extension handles 1002*b* may be employed to form an overall extension handle 1002.

Each elongated extension handle 1002*b* comprises on one end an extension handle connector 1004 that includes a first field emission structure 1006. Extension handle connector 1004 is adapted to mate with tool attachment connector 1014. First field emission structure 1006 is configured to match second field emission structure 1016. To ensure compatibility with an extension handle 1002*a* (or another elongated extension handle 1002*b*), each elongated extension handle 1002*b* comprises at the other end an extension handle connector 1004' that includes a first field emission structure 1006'. Extension handle connector 1004' is adapted to mate with extension handle connector 1004, and first field emission structure 1006' is configured to match first field emission structure 1006. Hence, by way of example only, an extension handle connector 1004' may be equivalent in shape, function, etc. to a tool attachment connector 1014, and a first field emission structure 1006' may be equivalent in configuration, function, etc. to a second field emission structure 1016.

Figure 13:
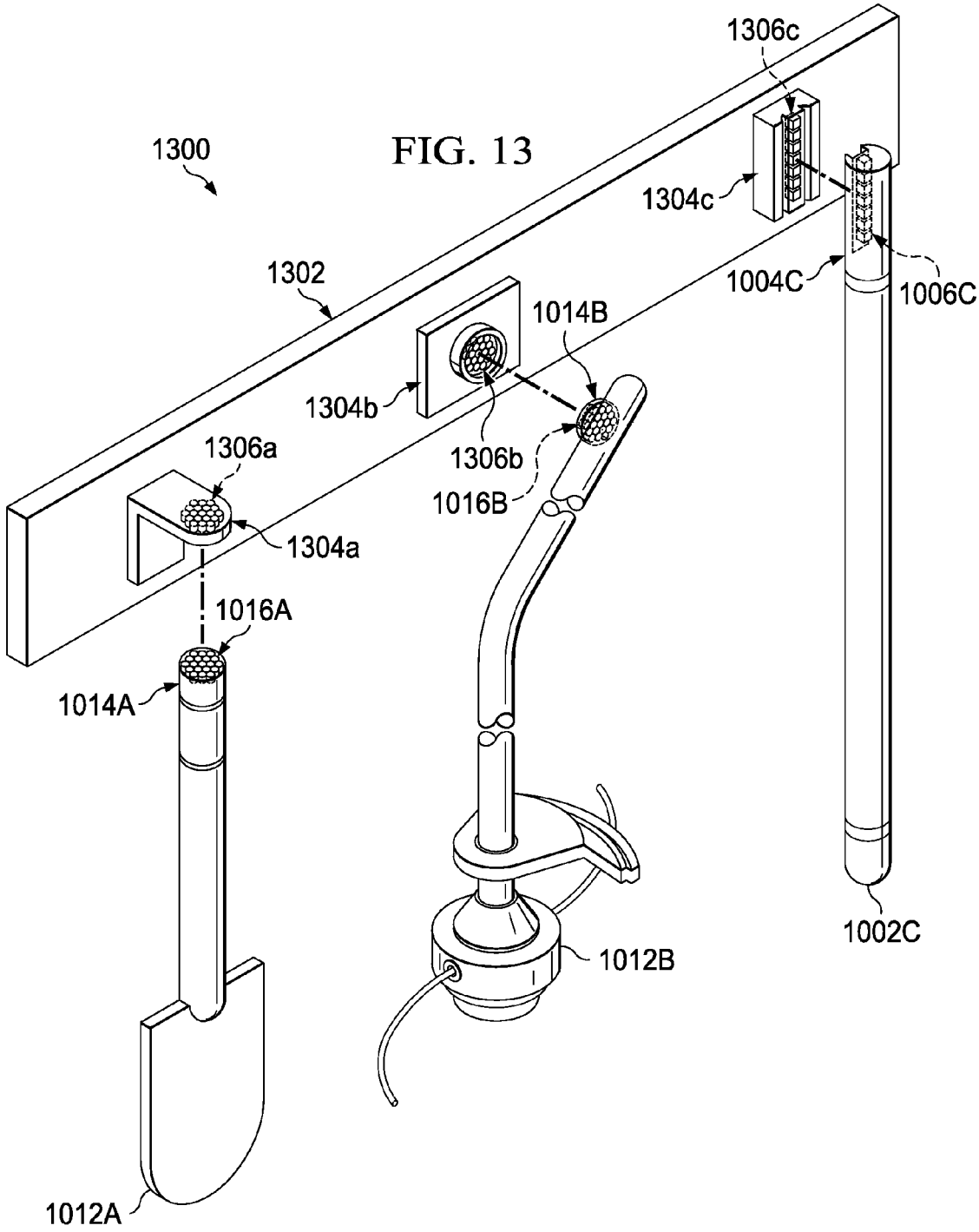
FIG. 13 illustrates an example storage component that is capable of holding one or more tool attachments and/or at least one extension handle.
Figure 14A:
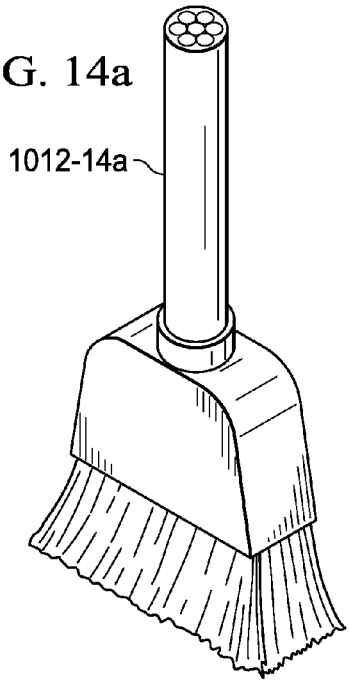
FIGS. 14*a*-14*d* depict example tool attachments that relate to cleaning tool implements.
Figure 14B:
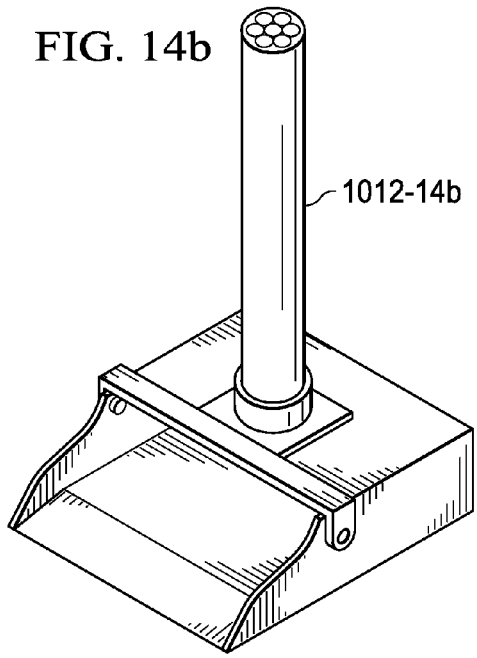
Figure 14C:
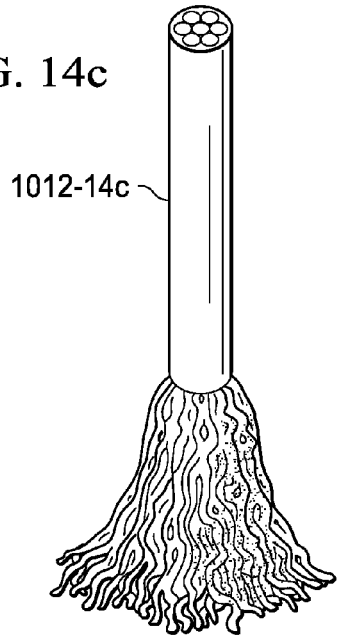
Figure 14D:
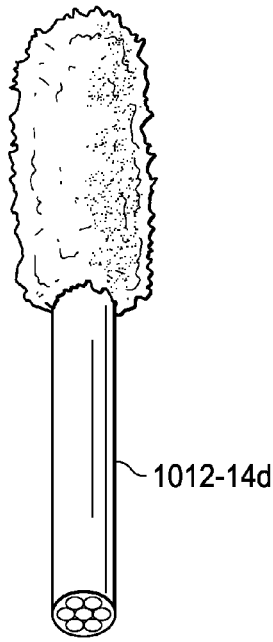
Figure 15A:
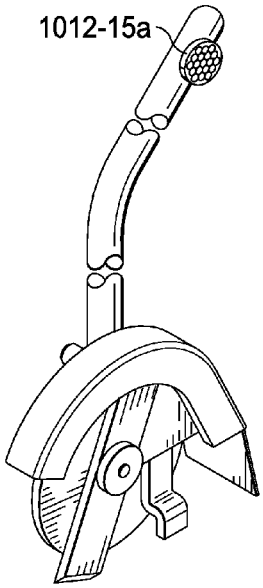
FIGS. 15*a*-15*e* depict example tool attachments that relate to landscaping tool implements.
Figure 15B:
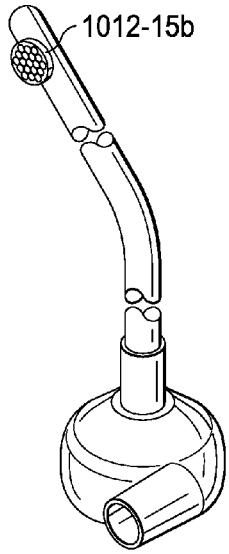
Figure 15D:
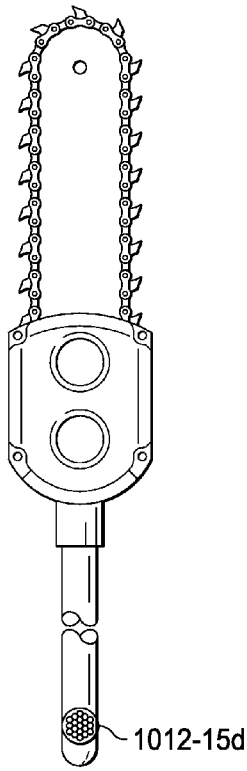
Figure 15C:
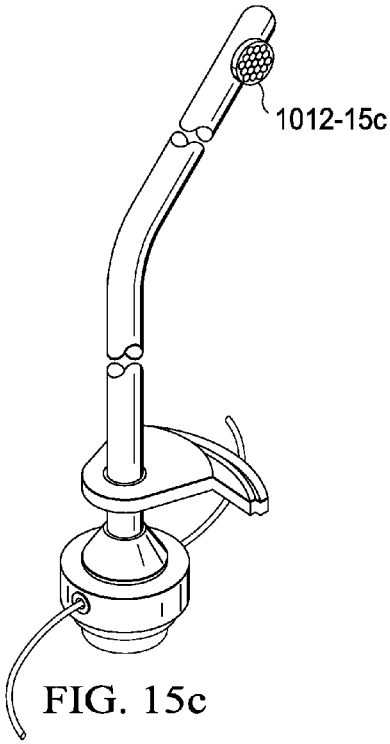
Figure 15E:
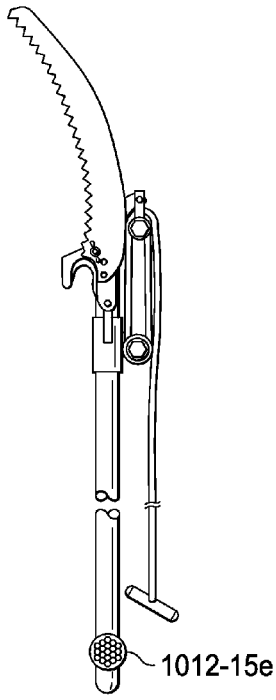

FIG. 13 illustrates an example storage component 1302 that is capable of holding one or more tool attachments 1012 and/or at least one extension handle 1002. As illustrated, storage component 1302 comprises three storage positions 1304 that respectively include three field emission structures 1306. However, more or fewer than three positions and associated structures (e.g., one or more) may alternatively be implemented with a storage component 1302. More specifically, storage component 1302 comprises a storage position 1304*a* that includes a field emission structure 1306*a*, a storage position 1304*b* that includes a field emission structure 1306*b*, and a storage position 1304*c* that includes a Field emission structure 1306*c*.

In an example embodiment, storage component 1302 is capable of being mounted on a wall or similar. A person may then store components 1002 and/or 1012 on storage component 1302 using spatial attraction forces between two field emission structures. As illustrated, three different connector-structure pair types are implemented by storage component 1302. Alternatively, the same connector-structure pair type or a different set of connector-structure pair types may be implemented on a given storage component 1302.

Tool attachment 1012A (which corresponds generally to the connector-structure pair illustrated in FIG. 10A) comprises a tool attachment connector 1014A that includes a second field emission structure 1016A. Tool attachment connector 1014A is adapted to mate to storage position 1304*a*. Second field emission structure 1016A is configured to match field emission structure 1306*a* to create an attractive holding force to secure tool attachment 1012A to storage component 1302.

Tool attachment 1012B (which corresponds generally to the inverse of the mechanisms illustrated in FIG. 10B such that the tool attachment includes a field emission structure statically affixed thereto) comprises a tool attachment connector 1014B that includes a second field emission structure 1016B. Tool attachment connector 1014B is adapted to mate to storage position 1304*b*. Second field emission structure 1016B is configured to match field emission structure 1306*b* to create an attractive holding force to secure tool attachment 1012B to storage component 1302.

Extension handle 1002C (which corresponds generally to the mechanisms illustrated in FIG. 10C) comprises an extension handle connector 1004C that includes a first field emission structure 1006C. Extension handle connector 1004C is adapted to mate to storage position 1304*c*. First field emission structure 1006C is configured to match field emission structure 1306*c* to create an attractive holding force to secure extension handle 1002C to storage component 1302.

FIGS. 14-18 illustrate different example categories of tool attachments. Each of FIGS. 14-18 depicts one or more examples for realizing tool implements 1010. More specifically, FIGS. 14-18 relate to cleaning tool implements, landscaping tool implements, bathroom maintenance tool implements, stability enhancement tool implements, and extended-reach tool implements, respectively. It should be understood that these categories are described by way of example only. Many other types of tool attachment categories may also be incorporated into the principles of the present invention.

As illustrated, each example tool attachment in FIGS. 14-18 is implemented in accordance with the example aspects of FIG. 10A or 10B for the sake of clarity. In other words, each example tool attachment comprises a tool attachment connector 1014 (not explicitly indicated in FIGS. 14-18) including a second field emission structure 1016 (not explicitly indicated in FIGS. 14-18) that are both substantially equivalent to the tool attachment connector 1014A and the second field emission structure 1016A of FIG. 10A or those of FIG. 10B. However, any of the tool attachments of FIGS. 14-18 may instead (or additionally) be implemented with any of the connector and field emission structure pair embodiments that are shown in the drawings and/or described herein, as well as equivalents, derivations, etc. thereof. The example tool attachments are not necessarily drawn to scale.

FIGS. 14*a*-14*d* depict example tool attachments 1012-14 that relate to cleaning tool implements. Four different cleaning tool attachments 1012-14 are illustrated. They are: a broom attachment 1012-14a, a dust pan attachment 1012-14*b*, a mop attachment 1012-14*c* (including a wet mop, a dust mop, etc.), and a dusting attachment 1012-14d. Although four different cleaning tool attachments 1012-14 are shown, other cleaning implements may be incorporated into a quick assembly tool. By way of example, but not limitation, other cleaning tool implements may include powered cleaning implements. For instance, powered cleaning tool attachments 1012-14 may include carpet and/or floor vacuum cleaner attachments, fabric (e.g., furniture, drapes, etc.) vacuum cleaner attachments, rug shampooers, and so forth. With a vacuum cleaner and/or rug shampooer implementation, extension handle 1002 may be at least partially hollow to allow for fluids and/or debris to be dispensed and/or retrieved by the connected cleaning tool attachment 1012-14.

Similarly, powered and manual cleaning tool attachments 1012-14 may also be realized for cleaning the internal and/or external parts of vehicles (e.g., cars, trucks, boats, planes, motor cycles, etc.). Such vehicle cleaning tool attachments (e.g., a stationary or moving brush), for example, may also enable the flow of fluids along extension handle 1002 and/or tool attachment 1012, may be powered by water pressure or otherwise, may be connectable to a hose, and so forth. Additionally, snow removal cleaning tool attachments (e.g., snow shovels, snow pushers, ice scrapers, snow roof brooms, etc.) may also be implemented. Snow removal tool attachments may also relate to landscaping tool implements.

FIGS. 15*a*-15*e* depict example tool attachments 1012-15 that relate to landscaping tool implements. Five different landscaping tool attachments 1012-15 are illustrated. They are: an edger attachment 1012-15*a*, a blower attachment 1012- 15*b*, a trimmer attachment 1012-15*c*, a motorized/power pruner attachment 1012-15*d*, and a manual pruner attachment 1012-15*e*. Thus, landscaping tool attachments 1012-15*a*, 1012-15*b*, 1012-15*c*, and 1012-15*d* may involve the use of some kind of motor, battery, or other power source, which may be realized as a facilitating instrument 1092 (of FIG. 10C). The motor, battery, or other power source, if associated with an extension handle 1002 (not explicitly shown in FIGS. 15*a*-15*e*), may drive the tool implement of the tool attachment 1012-15. Hence, a cable, a wire, a rod, etc. (which may be external and/or internal to each of extension handle 1002 and/or tool attachment 1012) may be interconnected at or around extension handle connector 1004 and tool attachment connector 1014 (e.g., all of FIGS. 10A-10C). Although five different landscaping tool attachments 1012-15 are shown, other landscaping implements may be incorporated into a quick assembly tool. By way of further example, but not limitation, other landscaping tool implements may include manual or unpowered landscaping implements. For instance, manual landscaping tool attachments 1012-15 may include a rake, a shovel, and so forth.

Figure 16A:
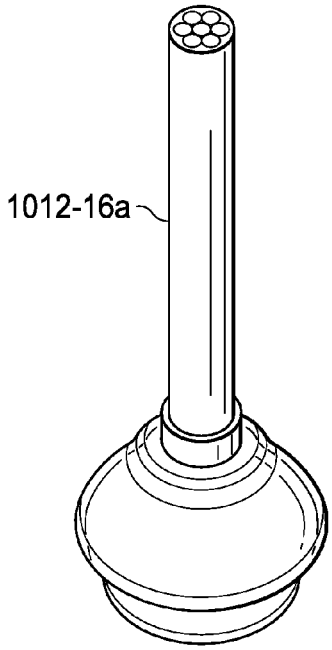
FIGS. 16*a* and 16*b* depict example tool attachments that relate to bathroom maintenance tool implements.
Figure 16B:
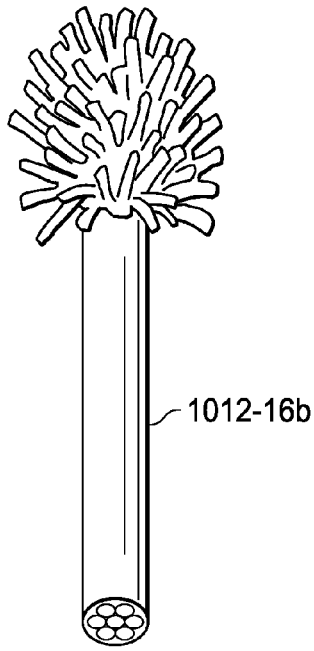

FIGS. 16*a* and 16*b* depict example tool attachments 1012-16 that relate to bathroom maintenance tool implements. Two different bathroom maintenance tool attachments 1012-16 are illustrated. They are: a plunger attachment 1012-16*a* and a toilet brush attachment 1012-16*b*. Although two different bathroom maintenance tool attachments 1012-16 are shown, other bathroom maintenance implements may be incorporated into a quick assembly tool.

Figure 17A:
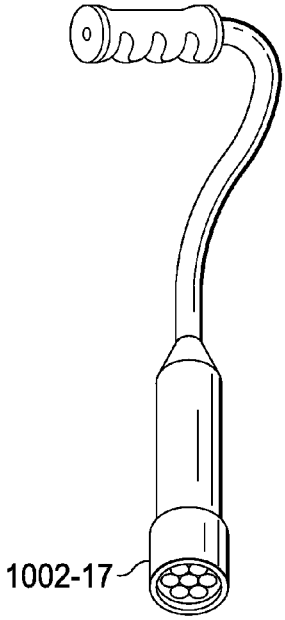
FIGS. 17*a*-17*c* depict example tool attachments that relate to stability enhancement tool implements, as well as a cane handle grip for an example extension handle.
Figure 17B:
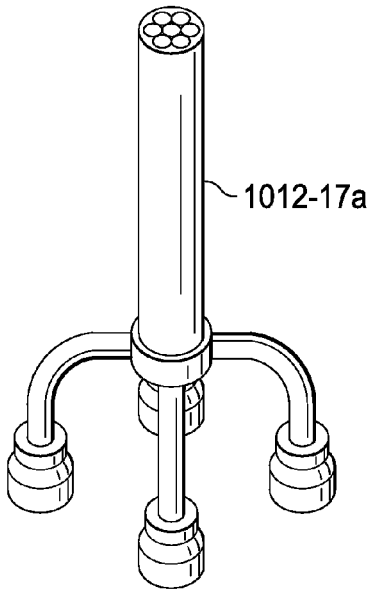
Figure 17C:
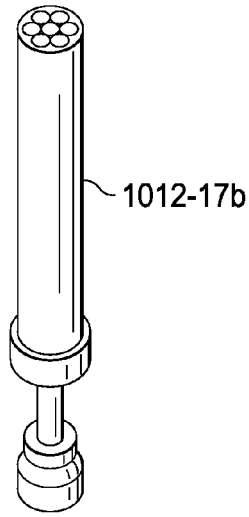

FIGS. 17*a*-17*c* depict example tool attachments 1012-17 that relate to stability enhancement implements, as well as a cane handle grip implementation for an extension handle 1002-17. Two different stability enhancement attachments 1012-17 are illustrated. They are: a four-prong cane tip attachment 1012-17*a* and a single-prong cane tip attachment 1012-17*b* in FIGS. 17*b* and 17*c*, respectively. FIG. 17*a* illustrates another example of an extension handle 1002. Specifically, a cane handle grip 1002-17 is shown that can be assembled with a stability enhancement attachment 1012-17. Although two different stability enhancement attachments 1012-17 are shown, other stability enhancement implements may be incorporated into a quick assembly tool.

Figure 18A:
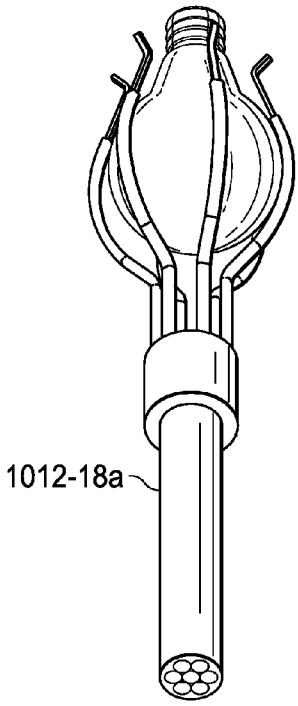
FIGS. 18*a*-18*c* depict example tool attachments that relate to extended-reach tool implements.
Figure 18B:
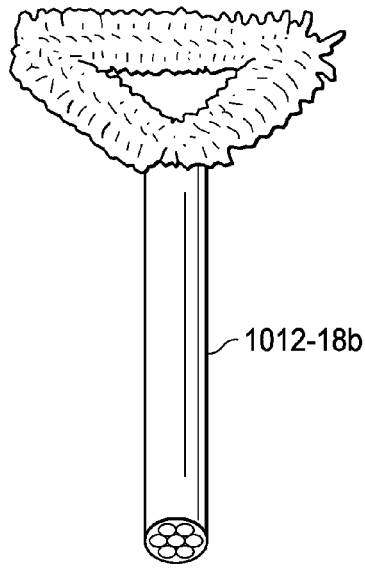
Figure 18C:
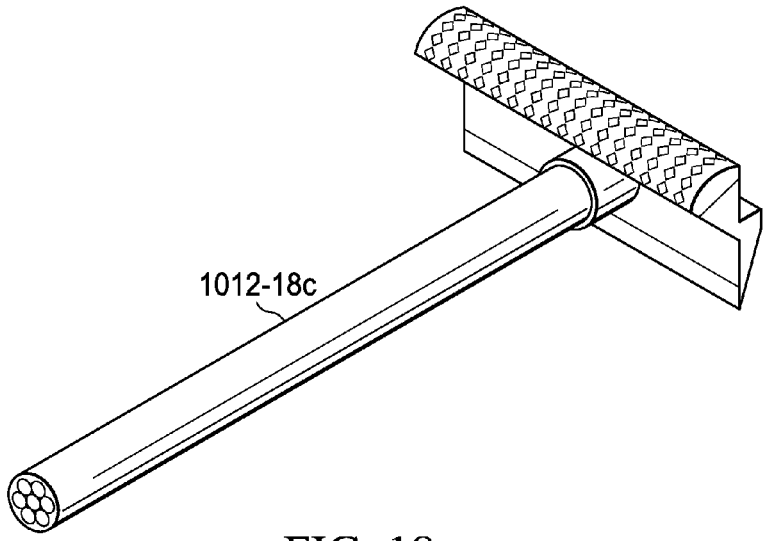

FIGS. 18*a*-18*c* depict example tool attachments 1012-18 that relate to extended-reach tool implements. Three different extended-reach tool attachments 1012-18 are illustrated. They are: a light-bulb changing attachment 1012-18*a*, a ceiling fan duster attachment 1012-18*b*, and a window cleaner attachment 1012-18*c*. Window cleaner attachment 1012-18*c* includes both a sponge implement and a squeegee implement. Although three different extended-reach tool attachments 1012-18 are shown, other extended-reach implements may be incorporated into a quick assembly tool. By way of example, but not limitation, other extended-reach tool implements may include those relating to painting. For instance, extended-reach tool attachments 1012-18 may include a paint roller, a paint brush, a paint scraper, and so forth. Additionally, extended-reach tool implements may include a trash or other grasping-type extended-reach tool attachment 1012-18, a fuse-changer (for a lineman) extended-reach tool attachment 1012-18, and so forth. Light-bulb changing, fuse-changing, trash collecting, etc. can be implemented with a trigger realization for facilitating instrument 1092 (of FIG. 10C) to operate the tool attachment.

It should be noted that not only are the different categories of tool attachments not exhaustive, they are also not mutually exclusive. For example, ceiling fan duster attachment 1012-18*b* and window cleaner attachment 1012-18*c* (of FIGS. 18*b* and 18*c*) may be considered to relate to cleaning tool implements. Similarly, both motorized/power pruner attachment 1012-15*d* and a manual pruner attachment 1012-5*e* (of FIGS. 15*d* and 15*e*) may be considered to relate to extended-reach tool implements. Furthermore, it should be understood generally that many other types of tool attachments and/or extension handles may be implemented in accordance with the present invention.

Figure 19:
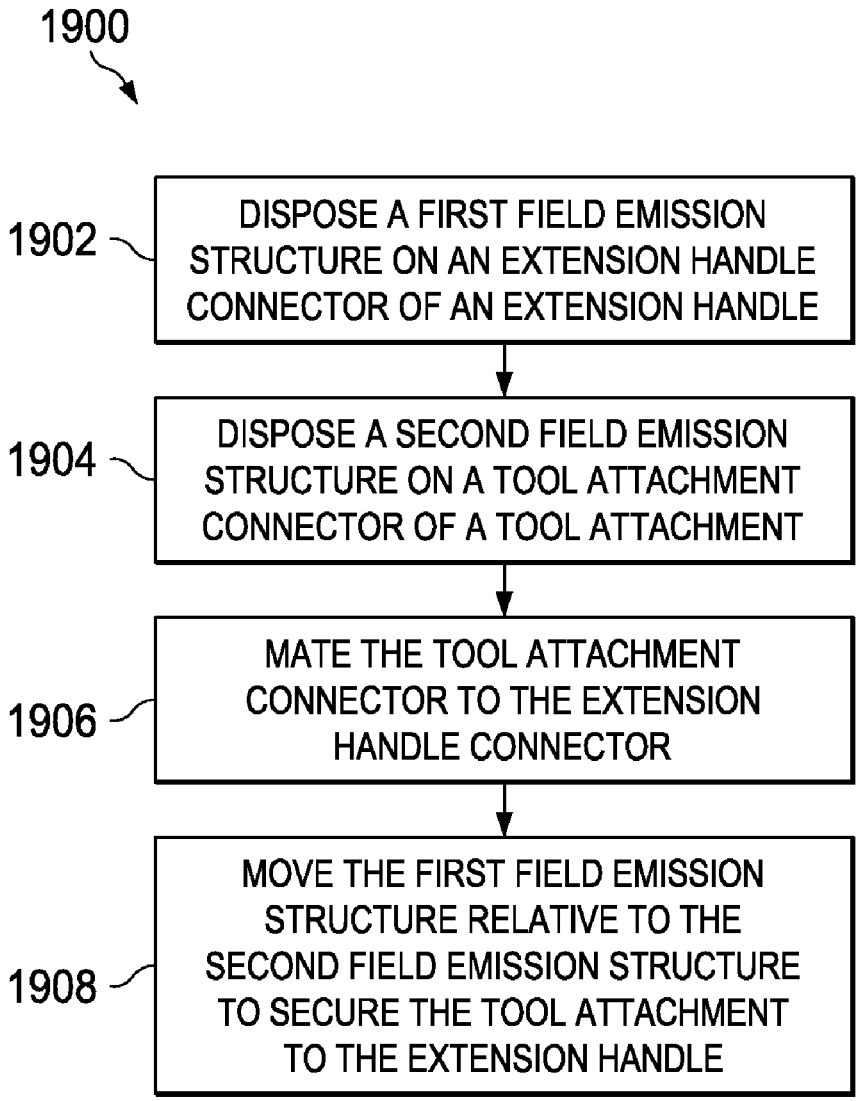
FIG. 19 is a flow diagram that illustrates an example method for constructing components of a tool and assembling the tool.

FIG. 19 is a flow diagram 1900 that illustrates an example method for constructing components of a tool and assembling the tool. As illustrated, flow diagram 1900 includes four steps 1902-1908. Although steps 1902-1908 are shown and described in a particular order, they may be performed in different orders and/or in a fully or partially overlapping manner. Generally, steps 1902 and 1904 pertain to constructing components of a tool that is capable of being quickly assembled, and steps 1906 and 1908 pertain to assembling the components into the tool.

In an example embodiment, for step 1902, a first field emission structure is disposed on an extension handle connector of an extension handle. For example, a first field emission structure 1006 may be disposed on an extension handle connector 1004 of an extension handle 1002. For step 1904, a second field emission structure is disposed on a tool attachment connector of a tool attachment. For example, a second field emission structure 1016 may be disposed on a tool attachment connector 1014 of a tool attachment 1012. The step or disposing may be accomplished by attaching a field emission structure to a connector, by integrating a field emission structure with a connector, some combination thereof, and so forth. For example, disposing may be accomplished by adhering a field emission structure to a connector; by inserting, injecting, or otherwise imposing a field emission structure onto/into a connector; by creating a connector so as to already include a field emission structure "bake in", some combination thereof, and so forth. Multiple field emission sources 1008 and/or 1018 may be disposed simultaneously or sequentially.

For step 1906, the tool attachment connector is mated to the extension handle connector. For example, tool attachment connector 1014 may be mated to extension handle connector 1004, which are adapted to be physically interfaced with each other. The mating may include causing first field emission structure 1006 to be at least proximate to second field emission structure 1016. For step 1908, the first field emission structure is moved relative to the second field emission structure to secure the tool attachment to the extension handle. More specifically, the first field emission structure is moved relative to the second field emission structure to increase a current spatial force in accordance with the predefined spatial force function and secure the tool attachment to the extension handle using, at least partially, the resulting predefined spatial force. For example, first field emission structure 1006 may be moved relative to second field emission structure 1016 to increase the predefined spatial force function between them and thereby secure tool attachment 1012 to extension handle 1002 using, at least partially, the resulting predefined spatial force.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims. It should also be noted that the reference to the "present invention" or "invention" used herein relates to exemplary embodiments and not necessarily to every embodiment that is encompassed by the appended claims.

The invention claimed is:

1. An apparatus comprising:

an extension handle having an extension handle connector, the extension handle connector including a first field emission structure; and a tool attachment having a tool attachment connector, the tool attachment connector including a second field emission structure; the tool attachment connector adapted to be mated to the extension handle connector with the second field emission structure in proximity to the first field emission structure such that the first and second field emission structures have a predetermined alignment with respect to one another; each of the first and second field emission structures including multiple field emission sources having positions and polarities relating to a predefined spatial force function that corresponds to the predetermined alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

2. The apparatus as recited in claim 1, wherein the extension handle and the tool attachment may be connected or disconnected from each other via the extension handle connector and the tool attachment connector by moving the first field emission structure relative to the second field emission structure.

3. The apparatus as recited in claim 2, wherein the relative movement between the first field emission structure and the second field emission structure to connect or disconnect the extension handle and the tool attachment comprises at least a relative rotational movement between the first field emission structure and the second field emission structure.

4. The apparatus as recited in claim 2, wherein the relative movement between the first field emission structure and the second field emission structure to connect or disconnect the extension handle and the tool attachment comprises at least a relative linear movement between the first field emission structure and the second field emission structure.

5. The apparatus as recited in claim 1, wherein the extension handle or the tool attachment includes at least one other field emission structure.

6. The apparatus as recited in claim 1, wherein the positions and the polarities of the field emission sources of the first and second field emission structures are configured in accordance with at least one correlation function.

7. The apparatus as recited in claim 6, wherein the at least one correlation function comports with at least one code.

8. The apparatus as recited in claim 7, wherein the at least one code comprises at least one of a pseudorandom code, a deterministic code, or a designed code; and wherein the at least one code comprises a one dimensional code, a two dimensional code, a three dimensional code, or a four dimensional code.

9. The apparatus as recited in claim 1, wherein each field emission source of the multiple field emission sources has a corresponding field emission amplitude and vector direction configured in accordance with the predefined spatial force function, wherein a separation distance between the first and second field emission structures and the predetermined alignment with respect to the first and second field emission structures creates a spatial force in accordance with the predefined spatial force function.

10. The apparatus as recited in claim 9, wherein the spatial force corresponds to a peak spatial force of the predefined spatial force function when the first and second field emission structures are substantially aligned such that each field emission source of the first field emission structure substantially aligns with a corresponding field emission source of the second field emission structure.

11. The apparatus as recited in claim 1, wherein at least one field emission source of the multiple field emission sources includes a magnetic field emission source or an electric field emission source.

12. The apparatus as recited in claim 1, wherein the field domain corresponds to first field emissions from the field emission sources of the first field emission structure interacting with second field emissions from the field emission sources of the second field emission structure.

13. The apparatus as recited in claim 1, further comprising:

a storage component that is capable of holding at least one of the extension handle or the tool attachment; the storage component comprising at least one storage position that is adapted to be mated to the extension handle connector or the tool attachment connector; the at least one storage position including a third field emission structure that is configured to match the first field emission structure or the second field emission structure.

14. The apparatus as recited in claim 1, further comprising:

an elongated extension handle comprising a first elongated extension handle connector that includes a third field emission structure and a second elongated extension handle connector that includes a fourth field emission structure; the first elongated extension handle connector adapted to be mated to the extension handle connector, the third field emission structure configured to match the first field emission structure; the second elongated extension handle connector adapted to be mated to the tool attachment connector, the fourth field emission structure configured to match the second field emission structure.

15. A method relating to a tool that may be assembled quickly, the method comprising:

disposing a first field emission structure on an extension handle connector of an extension handle; and disposing a second field emission structure on a tool attachment connector of a tool attachment;

wherein the tool attachment connector is adapted to be mated to the extension handle connector with the second field emission structure in proximity to the first field emission structure such that the first and second field emission structures have a predetermined alignment with respect to one another; each of the first and second field emission structures including multiple field emission sources having positions and polarities relating to a predefined spatial force function that corresponds to the predetermined alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

16. The method as recited in claim 15, further comprising:

mating the tool attachment connector to the extension handle connector to thereby connect the tool attachment to the extension handle; and moving the first field emission structure relative to the second field emission structure to increase a current spatial force between the first and second field emission structures in accordance with the predefined spatial force function to thereby secure the tool attachment to the extension handle.

17. A tool attachment that is capable of being connected to an extension handle having an extension handle connector, the extension handle connector including a first field emission structure; the tool attachment comprising:

a tool implement; and a tool attachment connector, the tool attachment connector including a second field emission structure; the tool attachment connector adapted to be mated to the extension handle connector with the second field emission structure in proximity to the first field emission structure such that the first and second field emission structures have a predetermined alignment with respect to one another; each of the first and second field emission structures including multiple field emission sources having positions and polarities relating to a predefined spatial force function that corresponds to the predetermined alignment of the first and second field emission structures within a field domain, said spatial force function being in accordance with a code, said code corresponding to a code modulo of said first plurality of field emission sources and a complementary code modulo of said second plurality of field emission sources, said code defining a peak spatial force corresponding to substantial alignment of said code modulo of said first plurality of field emission sources with said complementary code modulo of said second plurality of field emission sources, said code also defining a plurality of off peak spatial forces corresponding to a plurality of different misalignments of said code modulo of said first plurality of field emission sources and said complementary code modulo of said second plurality of field emission sources, said plurality of off peak spatial forces having a largest off peak spatial force, said largest off peak spatial force being less than half of said peak spatial force.

18. The tool attachment as recited in claim 17, wherein one or more field emission sources of the multiple field emission sources include at least one permanent magnet, electromagnet, electret, magnetized ferromagnetic material, portion of a magnetized ferromagnetic material, soft magnetic material, or superconductive magnetic material.

19. The tool attachment as recited in claim 17, wherein the tool implement comprises at least one cleaning tool implement.

20. The tool attachment as recited in claim 17, wherein the tool implement comprises at least one landscaping tool implement.

* * * * *